US006393978B1

(12) United States Patent
Sugawara et al.

(10) Patent No.: US 6,393,978 B1
(45) Date of Patent: May 28, 2002

(54) MULTICOLOR STENCIL PRINTER HAVING PRESSING MEMBER HOLDING DEVICES

(75) Inventors: Mitsuhiro Sugawara; Daisuke Hasebe; Naoki Okazaki, all of Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/525,530

(22) Filed: Mar. 15, 2000

(30) Foreign Application Priority Data

Mar. 16, 1999 (JP) ..... 11-070267
Nov. 19, 1999 (JP) ..... 11-329870

(51) Int. Cl.[7] ..... B41L 13/06; B41F 15/10
(52) U.S. Cl. ..... 101/115; 101/116; 101/118
(58) Field of Search ..... 101/114, 115, 101/116, 117, 118, 119, 120, 126, 129, 174, 183, 184, 185, 485, 211

(56) References Cited

U.S. PATENT DOCUMENTS 3,477,367 A * 11/1969 Richards ..... 101/184
6,129,013 A * 10/2000 Takasawa et al. ..... 101/116
2001/0007225 A1 * 7/2001 Takahashi ..... 101/116

FOREIGN PATENT DOCUMENTS

JP 01-290489 11/1989
JP 03-055276 3/1991
JP 6-32038 2/1994
JP 7-17121 1/1995
JP 10-297073 11/1998
JP 10-305649 11/1998
JP 10315601 A * 12/1998
JP 11-34467 2/1999
JP 11034467 A * 2/1999

* cited by examiner

*Primary Examiner*—Leslie J. Evanisko
(74) *Attorney, Agent, or Firm*—Oblon, Spivak, McClelland, Maier & Neustadt, P.C.

(57) ABSTRACT

A multicolor stencil printer including print drums each storing an ink of a particular color, pressing members each positioned and configured to move into contact with a particular one of the print drums to nip a recording medium for printing and move out of the contact to transport the recording medium toward downstream, and holding devices each assigned to a particular one of the pressing members for holding the particular one of the pressing members out of the contact with the particular one of the print drums, wherein in a color selective mode, the print drums and the pressing members selectively cooperate to nip the recording medium such that the holding devices assigned to unused pressing members hold the unused pressing members away from the print drums associated cooperatively with the unused pressing members.

9 Claims, 24 Drawing Sheets

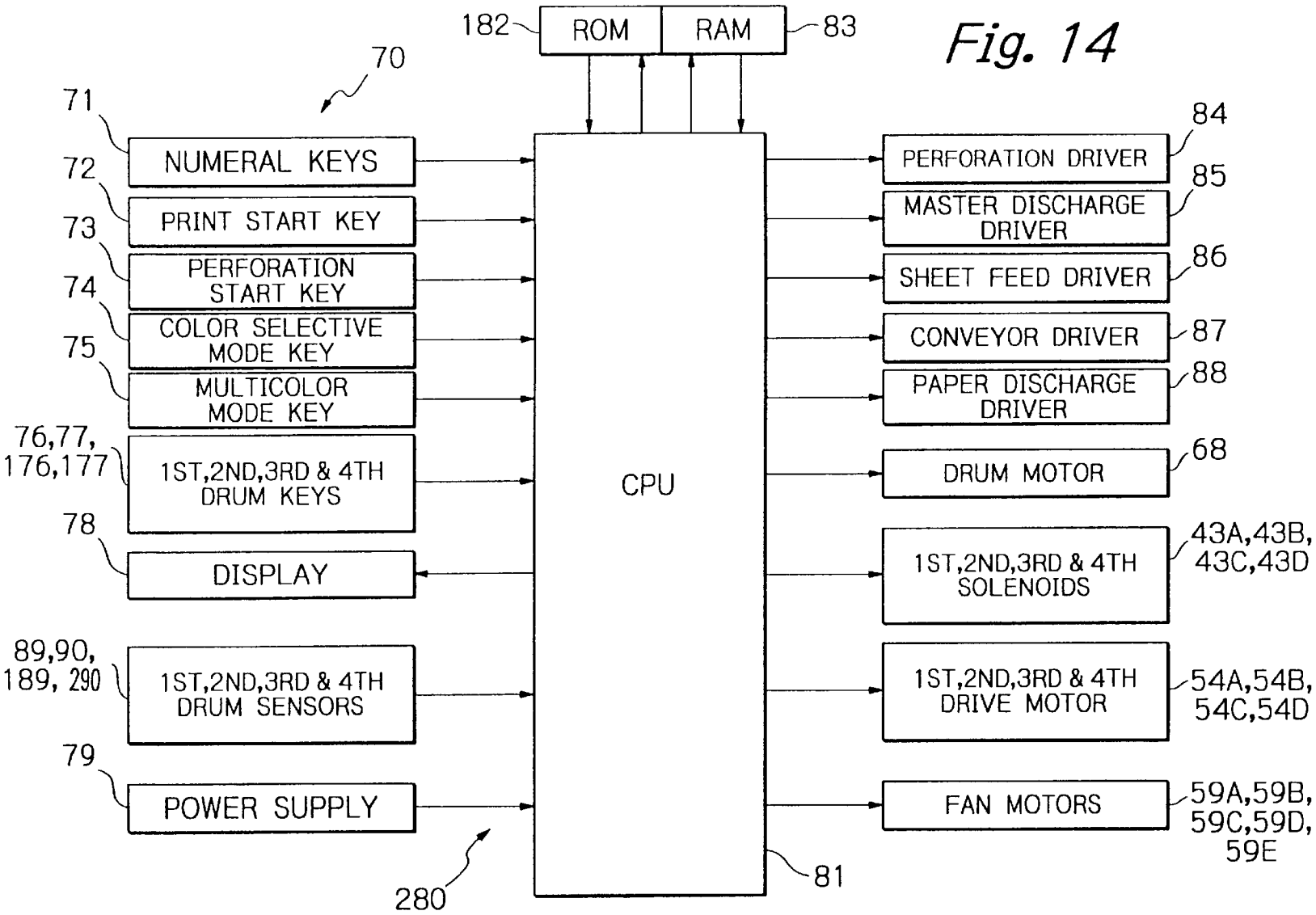
Fig. 14
PERFORATION DRIVER
MASTER DISCHARGE DRIVER
SHEET FEED DRIVER
CONVEYOR DRIVER
PAPER DISCHARGE DRIVER
DRUM MOTOR
1ST,2ND,3RD & 4TH SOLENOIDS
1ST,2ND,3RD & 4TH DRIVE MOTOR
FAN MOTORS
84
85
86
87
88
68
43A,43B, 43C,43D
54A,54B, 54C,54D
59A,59B, 59C,59D, 59E
83
RAM
ROM
182
CPU
81
280
70
NUMERAL KEYS
PRINT START KEY
PERFORATION START KEY
COLOR SELECTIVE MODE KEY
MULTICOLOR MODE KEY
1ST,2ND,3RD & 4TH DRUM KEYS
DISPLAY
1ST,2ND,3RD & 4TH DRUM SENSORS
POWER SUPPLY
71
72
73
74
75
76,77, 176,177
78
89,90, 189, 290
79

START
E1
READ MODE INFORMATION
E2
COLOR SELECTIVE MODE ?
NO
YES
11
E5
1ST DRUM KEY ON ?
7
NO
YES
E6
2ND DRUM KEY ON ?
8
NO
E7
YES
3RD DRUM KEY ON ?
9
NO
YES
E8
SELECT TRICOLOR MODE
E9
TURN ON 1ST TO 3RD SOLENOIDS
E10
TURN ON 4TH DRIVE MOTOR
10
E11
TURN ON FAN MOTORS
E3
SELECT MULTICOLOR MODE
E4
TURN ON ALL SOLENOIDS
END

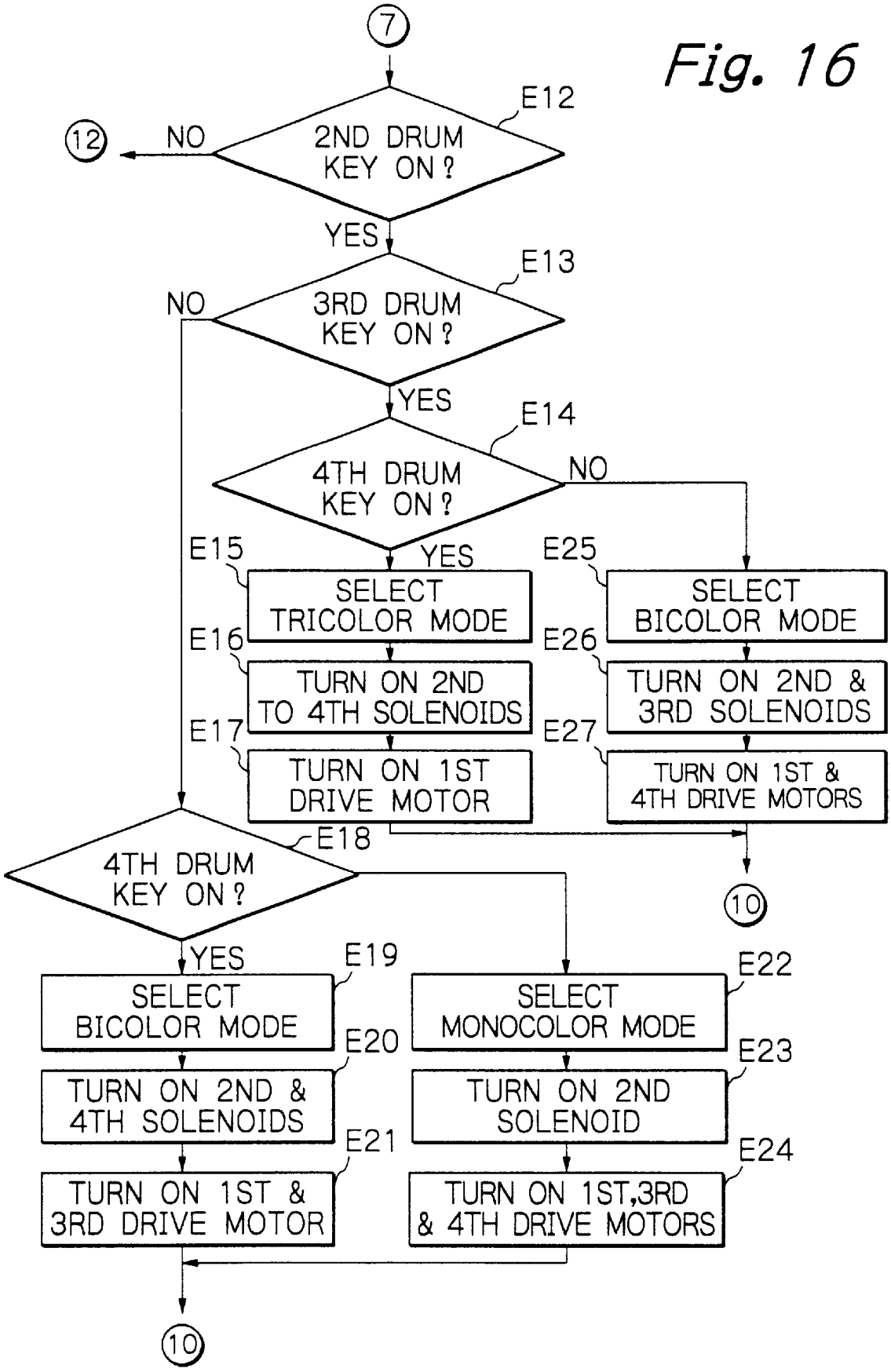
Fig. 16
7
E12
2ND DRUM KEY ON ?
NO
12
YES
E13
3RD DRUM KEY ON ?
NO
YES
E14
4TH DRUM KEY ON ?
NO
YES
E15
SELECT TRICOLOR MODE
E16
TURN ON 2ND TO 4TH SOLENOIDS
E17
TURN ON 1ST DRIVE MOTOR
E25
SELECT BICOLOR MODE
E26
TURN ON 2ND & 3RD SOLENOIDS
E27
TURN ON 1ST & 4TH DRIVE MOTORS
10
E18
4TH DRUM KEY ON ?
YES
E19
SELECT BICOLOR MODE
E20
TURN ON 2ND & 4TH SOLENOIDS
E21
TURN ON 1ST & 3RD DRIVE MOTOR
E22
SELECT MONOCOLOR MODE
E23
TURN ON 2ND SOLENOID
E24
TURN ON 1ST,3RD & 4TH DRIVE MOTORS
10

12
E28
3RD DRUM KEY ON ?
NO
YES
E29
4TH DRUM KEY ON ?
NO
YES
E30
SELECT BICOLOR MODE
E31
TURN ON 3RD & 4TH SOLENOIDS
E32
TURN ON 1ST & 2ND DRIVE MOTORS
E33
SELECT MONOCOLOR MODE
E34
TURN ON 3RD SOLENOIDS
E35
TURN ON 1ST,2ND & 4TH DRIVE MOTORS
10
E36
4TH DRUM KEY ON ?
NO
11
YES
E37
SELECT MONOCOLOR MODE
E38
TURN ON 4TH SOLENOID
E39
TURN ON 1ST TO 3RD DRIVE MOTORS
10

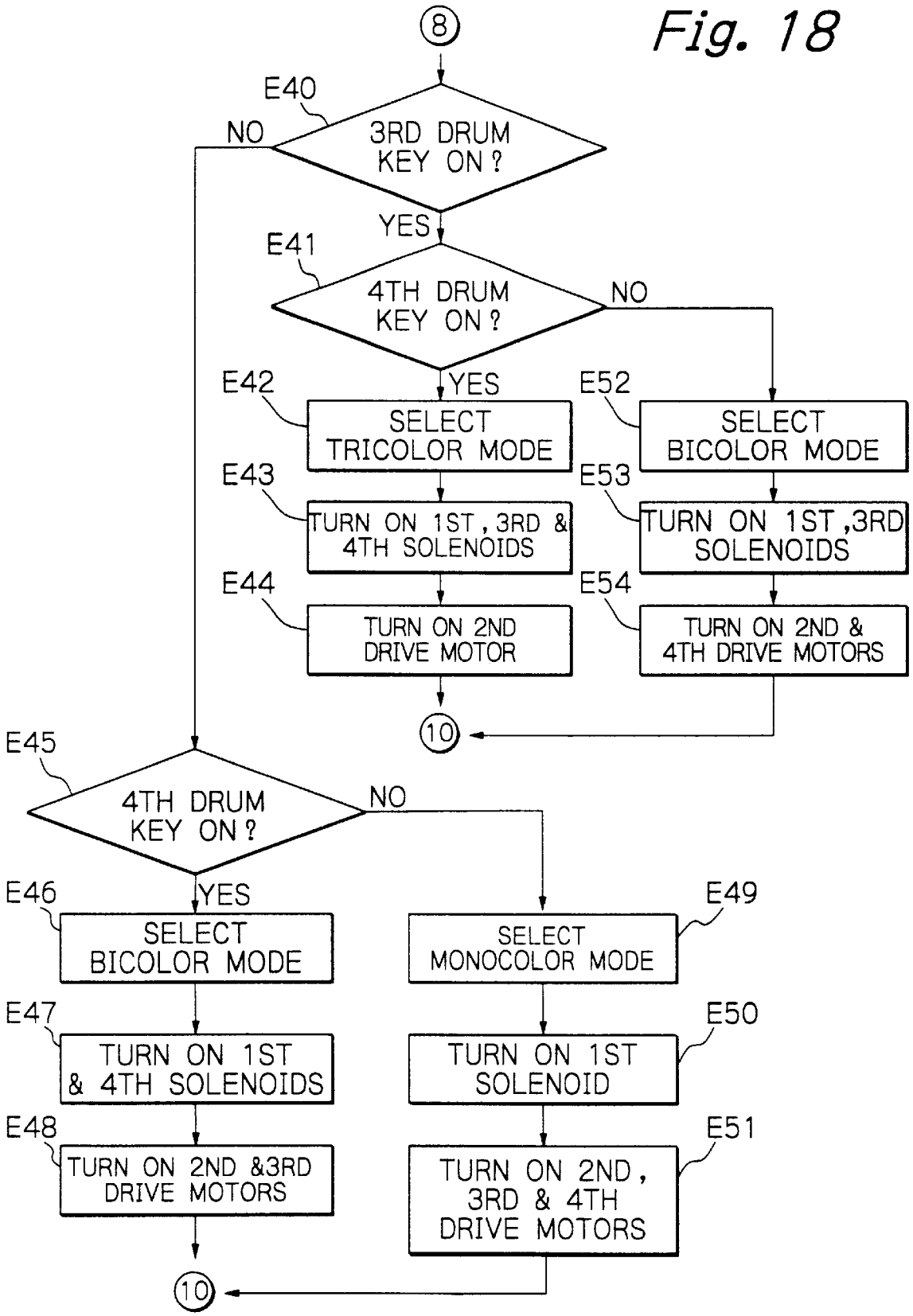
Fig. 18
8
E40
3RD DRUM KEY ON ?
NO
YES
E41
4TH DRUM KEY ON ?
NO
YES
E42
SELECT TRICOLOR MODE
E43
TURN ON 1ST, 3RD & 4TH SOLENOIDS
E44
TURN ON 2ND DRIVE MOTOR
E52
SELECT BICOLOR MODE
E53
TURN ON 1ST, 3RD SOLENOIDS
E54
TURN ON 2ND & 4TH DRIVE MOTORS
10
E45
4TH DRUM KEY ON ?
NO
YES
E46
SELECT BICOLOR MODE
E47
TURN ON 1ST & 4TH SOLENOIDS
E48
TURN ON 2ND &3RD DRIVE MOTORS
E49
SELECT MONOCOLOR MODE
E50
TURN ON 1ST SOLENOID
E51
TURN ON 2ND, 3RD & 4TH DRIVE MOTORS
10

START
D1
READ INFORMATION
D2
ALL DRUM SENSORS ON ?
YES
NO
D5
1ST DRUM SENSOR ON ?
NO
1
YES
D6
2ND DRUM SENSOR ON ?
NO
2
YES
D7
3RD DRUM SENSOR ON ?
NO
3
YES
D8
SELECT TRICOLOR MODE
D9
TURN ON 1ST TO 3RD SOLENOIDS
D10
TURN ON 4TH DRIVE MOTOR
4
D11
TURN ON FAN MOTORS
5
D3
SELECT MULTICOLOR MODE
D4
TURN ON ALL SOLENOIDS
END

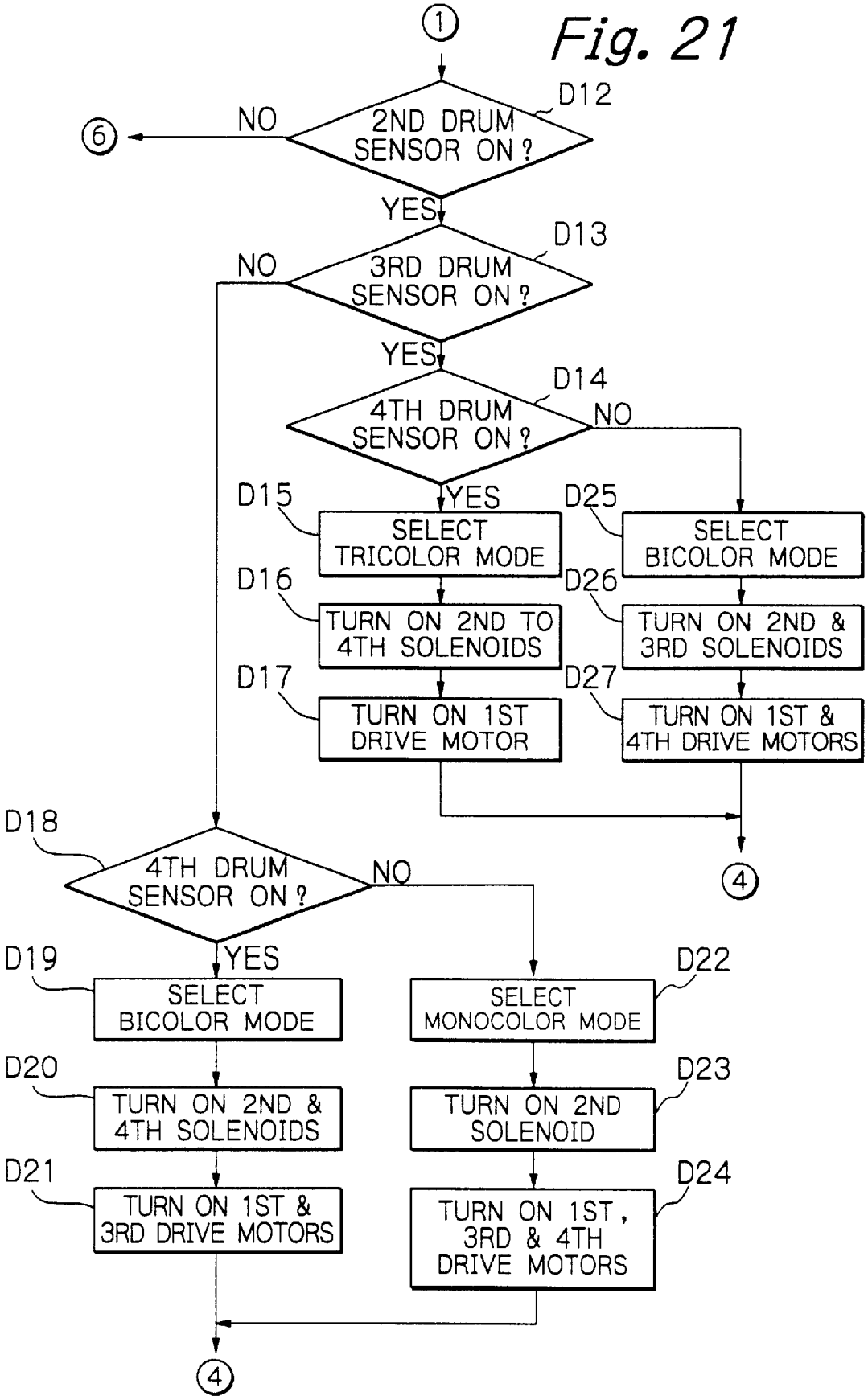
Fig. 21
1
D12
2ND DRUM SENSOR ON ?
NO
6
YES
D13
3RD DRUM SENSOR ON ?
NO
YES
D14
4TH DRUM SENSOR ON ?
NO
YES
D15
SELECT TRICOLOR MODE
D16
TURN ON 2ND TO 4TH SOLENOIDS
D17
TURN ON 1ST DRIVE MOTOR
D25
SELECT BICOLOR MODE
D26
TURN ON 2ND & 3RD SOLENOIDS
D27
TURN ON 1ST & 4TH DRIVE MOTORS
4
D18
4TH DRUM SENSOR ON ?
NO
YES
D19
SELECT BICOLOR MODE
D20
TURN ON 2ND & 4TH SOLENOIDS
D21
TURN ON 1ST & 3RD DRIVE MOTORS
D22
SELECT MONOCOLOR MODE
D23
TURN ON 2ND SOLENOID
D24
TURN ON 1ST, 3RD & 4TH DRIVE MOTORS
4

6
D28
3RD DRUM SENSOR ON ?
NO
YES
D29
4TH DRUM SENSOR ON ?
NO
YES
D30
SELECT BICOLOR MODE
D31
TURN ON 3RD & 4TH SOLENOIDS
D32
TURN ON 1ST & 2ND DRIVE MOTORS
D33
SELECT MONOCOLOR MODE
D34
TURN ON 3RD SOLENOID
D35
TURN ON 1ST, 2ND & 4TH DRIVE MOTORS
4
D36
4TH DRUM SENSOR ON ?
NO
YES
D37
SELECT BICOLOR MODE
D38
TURN ON 4TH SOLENOID
D39
TURN ON 1ST TO 3RD DRIVE MOTORS
4
D40
DISPLAY ABSENCE OF DRUMS
5

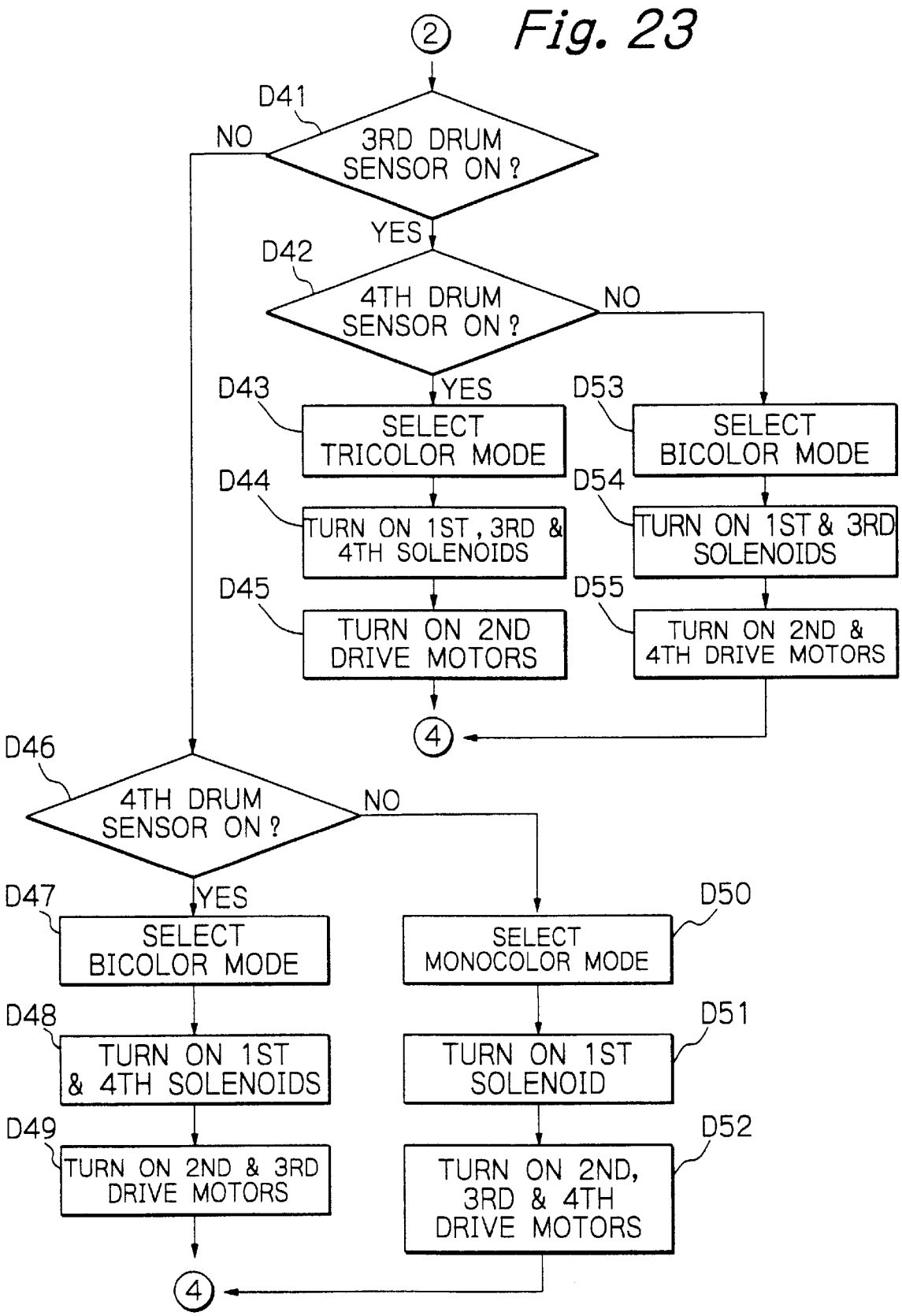
Fig. 23
2
D41
3RD DRUM SENSOR ON ?
NO
YES
D42
4TH DRUM SENSOR ON ?
NO
YES
D43
SELECT TRICOLOR MODE
D44
TURN ON 1ST, 3RD & 4TH SOLENOIDS
D45
TURN ON 2ND DRIVE MOTORS
D53
SELECT BICOLOR MODE
D54
TURN ON 1ST & 3RD SOLENOIDS
D55
TURN ON 2ND & 4TH DRIVE MOTORS
4
D46
4TH DRUM SENSOR ON ?
NO
YES
D47
SELECT BICOLOR MODE
D48
TURN ON 1ST & 4TH SOLENOIDS
D49
TURN ON 2ND & 3RD DRIVE MOTORS
D50
SELECT MONOCOLOR MODE
D51
TURN ON 1ST SOLENOID
D52
TURN ON 2ND, 3RD & 4TH DRIVE MOTORS
4

MULTICOLOR STENCIL PRINTER HAVING PRESSING MEMBER HOLDING DEVICES

BACKGROUND OF THE INVENTION

The present invention relates to a stencil printer capable of printing a multicolor image on a paper or similar recording medium with a plurality of print drums.

A multicolor stencil printer of the type including a plurality of parallel print drums arranged in a direction of paper conveyance is conventional and taught in, e.g., Japanese Patent Laid-Open Publication No. 10-297073. In this type of printer, pressing members each are movable into and out of contact with a particular print drum. When each pressing member is pressed against the associated print drum with the intermediary of a paper or similar recording medium, the rotation of the print drum is transferred to a paper. As a result, an image is printed on the paper being conveyed by the print drum. The paper with the image is driven out to a print tray located at the most downstream side of the printer.

A problem with the above multicolor stencil printer is that even in a monocolor print mode, all the pressing members are pressed against the associated print drums and cause ink to be transferred from unused print drums to the corresponding pressing members and a paper. To solve this problem, it has been customary to wrap non-perforated stencils around the unused print drums and thereby prevent ink from depositing on the associated pressing members and paper. This is, however, undesirable from the cost standpoint because non-perforated stencils must be wrapped around the unused print drums every time the monocolor print mode is selected. Another problem is that because the print tray is located at the most downstream side in the direction of paper conveyance, sufficient conveying forces do not act on the paper when the pressing members are released from the print drums, resulting in defective paper conveyance.

Technologies relating to the present invention are also disclosed in, e.g., Japanese Patent Laid-Open Publication Nos. 1-290489, 3-55276, 6-32038, 7-17121, 10-305649, and 11-34467.

SUMMARY OF THE INVENTION

It is therefore an object of the present invention to provide a multicolor stencil printer which does not require non-perforated stencils around unused print drums and thereby reducing the print cost.

It is another object of the present invention to provide a multicolor stencil printer capable of exerting a sufficient conveying force on a paper even when a pressing member does not press it and thereby obviating defective paper conveyance.

A multicolor stencil printer of the present invention includes a plurality of print drums each storing ink of particular color therein, a plurality of pressing members each being movable into and out of contact with a particular print drum, and a plurality of holding devices each being assigned to a particular pressing member. In a color selective print mode in which the print drums and pressing members selectively cooperate to nip a recording medium for printing an image, the holding devices associated with the pressing members unused in the above mode hold the pressing members at positions spaced from the associated print drums.

BRIEF DESCRIPTION OF THE DRAWINGS

The above and other objects, features and advantages of the present invention will become more apparent from the following detailed description taken with the accompanying drawings in which:

FIG. 14 is a block diagram showing control means included in the illustrative embodiment;

FIGS. 15 through 19 are flowcharts demonstrating a specific control procedure available with the control means shown in FIG. 14; and FIGS. 20 through 24 are flowcharts demonstrating another specific control procedure available with the control means shown in FIG. 14.

DESCRIPTION OF THE PREFERRED EMBODIMENTS

Figure 1:
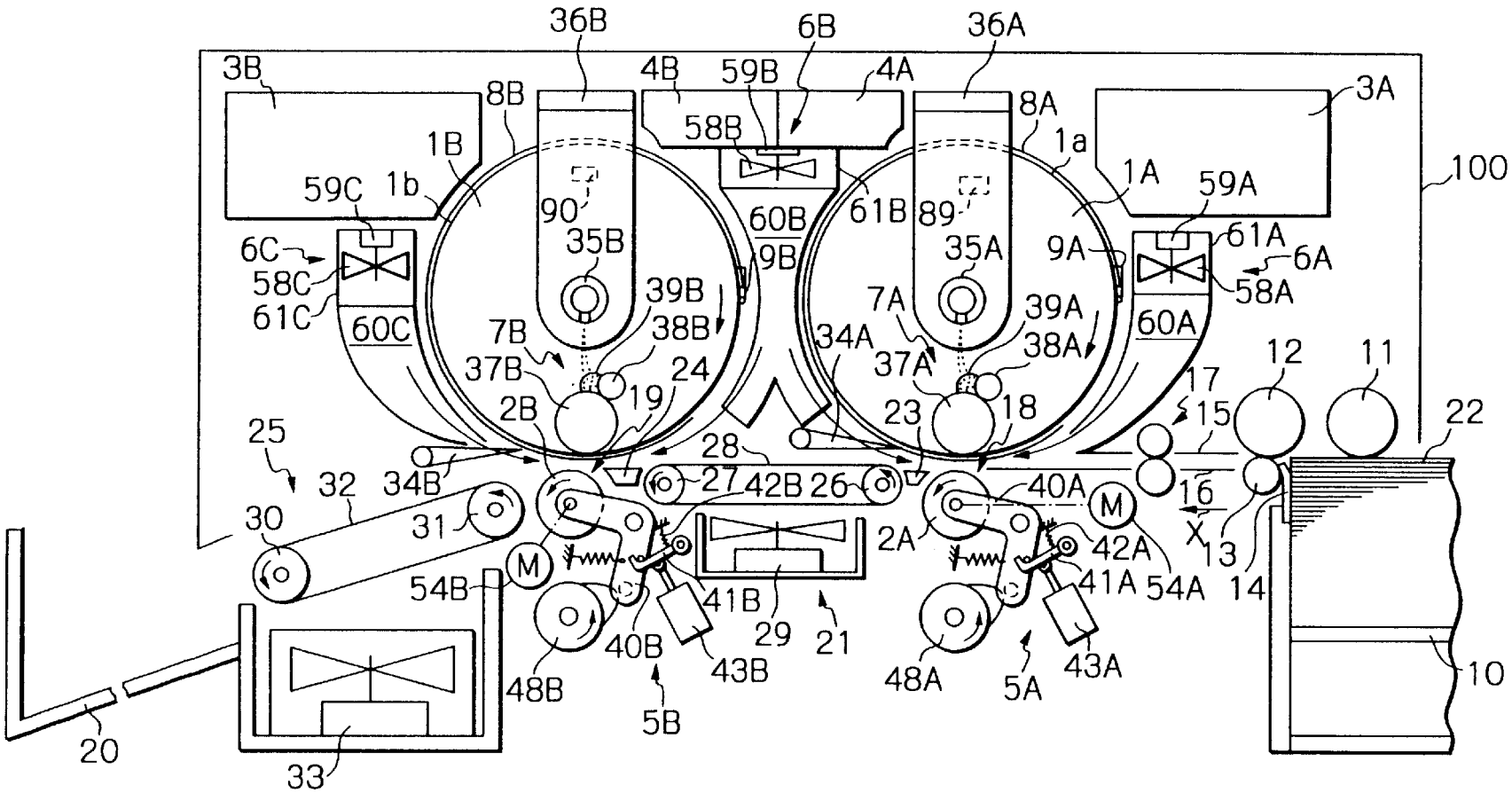
FIG. 1 is a view showing a multicolor stencil printer embodying the present invention.

Referring to FIG. 1 of the drawings, a multicolor stencil printer embodying the present invention is shown. As shown, the printer includes a printer body 100 accommodating first and second print drums 1A and 1B arranged in parallel in this order from the upstream side to the downstream side in a direction of paper conveyance X. The print drums 1A and 1B each store ink of a particular color thereinside. First and second press rollers 2A and 2B are also accommodated in the printer body 100 and movable into and out of contact with the print drums 1A and 1B, respectively. The printer is selectively operable in a multicolor mode or a color selective mode, as desired. In the multicolor mode, the print drum 1A and press roller 2A and the print drum 1B and press roller 2B each cooperate to nip a paper or similar recording medium 22 for printing a multicolor image thereon. In the color selective mode, either the print drum 1A and press roller 2A or the print drum 1B and press roller 2B nip the paper 22 for printing an image thereon in a desired color or colors. Control means 80 (see FIG. 5) sets up either the multicolor mode or color selective mode, as desired.

Conventional master making devices 3A and 3B, master discharging devices 4A and 4B, holding means 5A and 5B and air sending means 6A, 6B and 6C are arranged around the print drums 1A and 1B, respectively. The holding means 5A and 5B respectively hold the press rollers 2A and 2B at positions spaced from the outer circumferences 1*a* and 1*b* of the print drums 1A and 1B (spaced positions hereinafter). Ink feeding means 7A and 78 are arranged within the print drums 1A and 1B, respectively. The print drums 1A and 1B, press rollers 2A and 2B, master making devices 3A and 3B, master discharging devices 4A and 4B, holding means 5A and 5B, air sending means 6A through 6C and ink feeding means each are substantially identical in construction and operation and will be simply distinguished by the addition of suffices A, B and C.

The printer includes a scanner, not shown, mounted on the upper portion of the printer body 100 for reading a document. A CCD (Charge Coupled Device) image sensor or similar image sensor, not shown, photoelectrically transforms an imagewise reflection from the document to an electric image signal. An analog-to-digital converter, not shown, digitizes the electric image signal and selectively sends the resulting digital signal to the master making device 3A or 3B. The master making device 3A or 3B perforates a stencil with a conventional thermal head, not shown, in accordance with the digital image signal, thereby making a master 8A or 8B. The master 8A and 8B are conveyed toward the outer circumferences 1*a* and 1*b* of the print drums 1A and 1B, respectively. Clampers 9A and 9B are mounted on the outer circumferences 1*a* and 1*b* of the print drums 1A and 1B, respectively. The dampers 9A and 9B each clamp the leading edge of the respective master 8A or 8B. The print drum 1A or 1B is rotated to wrap the master 8A or 8B, respectively, around the outer circumference 1*a* or 1*b*. When a new master is to be made after the previous printing operation, the master discharging devices 4A and 4B respectively peel off the used masters 8A and 8B wrapped around the print drums 1A and 1B and collect them in boxes 4A and 4B. The control means 80 controls the various devices including the master making devices 3A and 3B and master discharging devices 4A and 4B via drive sections that will be described specifically later.

The print drums 1A and 1B each have a conventional porous, cylindrical configuration. The print drums 1A and 1B are rotatably mounted on drum shafts 35A and 35B, respectively. Frames 36A and 36B are removably mounted on the printer body 100 and support opposite ends of the drum shafts 35A and 35B, respectively. The print drums 1A and 1B are therefore removable from the printer body 100. The print drums 1A and 1B are interconnected by a gear train, a belt and pulley device or similar conventional power transmission mechanism. A drum motor 68 (see FIG. 5) is drivably connected to the power transmission mechanism in order to cause the print drums 1A and 1B to rotate in the clockwise direction, as viewed in FIG. 1, or printing direction. The control means 80 controls the print drum motor 68 in order to control the speed and direction of rotation of the print drums 1A and 1B. Specifically, the print drums 1A and 1B each are rotated clockwise at a higher speed during printing than during the interval between a master feeding operation and a master adhering operation.

Papers 22 are stacked on an elevatable tray 10 located at the most upstream side in the direction of paper conveyance X. A pickup roller 11, a pair of separator rollers 12 and 13 and a separator plate 14 cooperate to pay out the top paper 22 from the tray 10 while separating it from the underlying papers 22. The paper 22 paid out from the tray 10 is conveyed toward a registration roller pair 17 while being guided by guides 15 and 16. The registration roller pair 17 conveys the paper 22 at a preselected timing. The press roller 2A and print drum 1A define a print position 18 therebetween while the press roller 2B and print drum 1B define a print position 19 therebetween. The paper 22 conveyed by the registration roller pair 17 is sequentially routed through the above print positions 18 and 19 to a print tray 20 located at the downstream side in the direction of paper conveyance X. The control means 80 causes the pickup roller 11, separator rollers 12 and 13 and registration rollers 17 to rotate via drive sections that will be described specifically later. Particularly, after the master 8A or 8B has been wrapped around the print drum 1A or 1B, the control means 80 causes the above rollers to feed a single paper 22 in order to bring the master 8A or 8B into close adhesion to the drum 1A or 1B.

A conveyor 21 extends between the two print positions 18 and 19 and forms a paper conveyance path between the print drums 1A and 1B. Guides 23 and 24 respectively precede and follow the conveyor 21. A paper discharging device 25 is positioned between the print position 19 and the tray 20. The conveyor 21 includes a porous belt 28 passed over a drive roller 26 and a driven roller 27, and a suction fan 29 positioned below the belt 28. While the belt 28 is caused to turn counterclockwise, as viewed in FIG. 1, the suction fan 29 exerts a sucking force on the upper surface of the belt 28. The conveyor 21 is so configured as to convey the paper 22 coming out of the print position 18 to the downstream side in the direction X, i.e., the print position 19 while retaining the paper 22 on the belt 28 by suction.

The paper discharging device 25 includes a porous belt 32 passed over a drive roller 30 and a driven roller 31, and a suction fan 33 positioned below the belt 32. While the belt 32 is caused to turn counterclockwise, as viewed in FIG. 1, the suction fan 33 exerts a sucking force on the upper surface of the belt 32. The paper discharging device 25 is so configured as to convey the paper 22 coming out of the print position 19 toward the tray 20 while retaining the paper 22 on the belt 32 by suction. The control means 80 controls the operation of the conveyor 21 and paper discharging device 25 via drive sections that will be described specifically later.

Peelers 34A and 34B are respectively positioned above the conveyor 21 and paper discharging device 25 in order to remove the paper 22 from the print drums 1A and 1B. The peelers 34A and 34B each have a comb-like configuration and extend in the widthwise direction of the paper 22. The air sending means 6B and 6C respectively send air toward positions around the print positions 18 and 19.

The ink feeding means 7A includes an ink roller 37A and a doctor roller 38A arranged within the print drum 1A and forming an ink well 39A therebetween. The rollers 37A and 38A are rotated to feed ink from the ink well 39A to the inner periphery of the print drum 1A while kneading it. Likewise, the ink feeding means 7B includes an ink roller 37B and a doctor roller 38B arranged within the print drum 1B and forming an ink well 39B therebetween. The rollers 37B and 38B operate in the same manner as the rollers 37A and 38A except that they feed ink to the inner periphery of the print drum 1B. The drum shafts 35A and 35B each are formed with a plurality of holes in the axial direction and communicated to a particular ink pack storing ink of a particular color via a respective ink pump. In this sense, the drum shafts 35A and 35B play the role of ink feed pipes. Ink of a particular color is fed from each of the drum shafts 35A and 35B to the ink well 39A or 39B, respectively. In the illustrative embodiment, black ink and red ink are respectively fed to the ink wells 39A and 39B when ink in the ink wells 39A and 39B is consumed.

The holding means 5A includes an arm 40A supporting the press roller 2A such that the roller 2A is movable into and out of contact with the print drum 1A. A stop 41A is engagable with the arm 40A. A tension spring or biasing means 42A constantly biases the stop 41A in a direction in which the stop 41A engages with the arm 40A. A first electromagnetic solenoid or actuator 43A moves the stop 41A away from the arm 40A. Likewise, the holding means 5B includes an arm 40B supporting the press roller 2B such that the roller 2B is movable into and out of contact with the print drum 1B. A stop 41B is engageable with the arm 40B. A tension spring or biasing means 42B constantly biases the stop 41B in a direction in which the stop 41B engages with the arm 40B. A second electromagnetic solenoid or actuator 43B moves the stop 41B away from the arm 40B.

Figure 2:
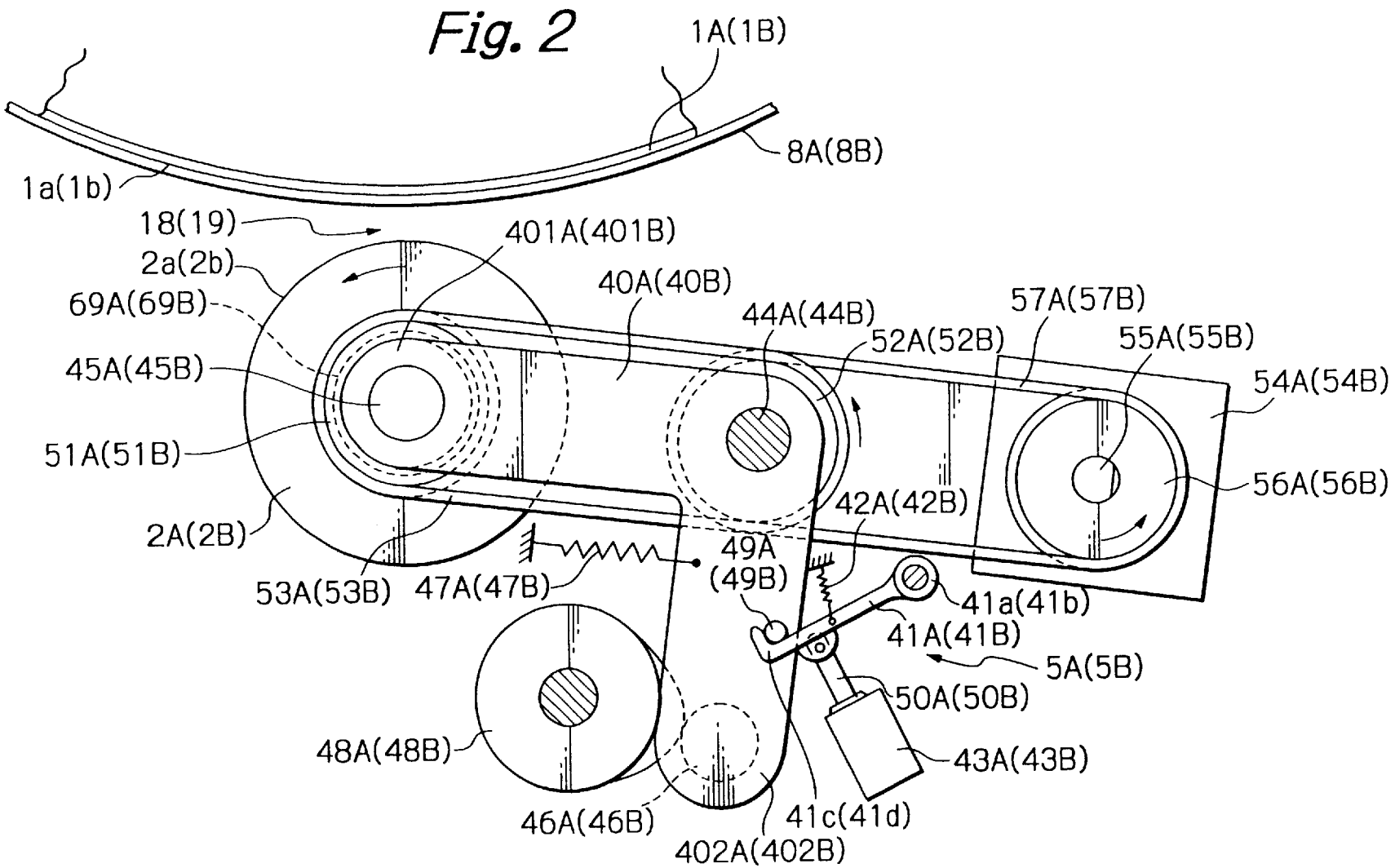
FIG. 2 is an enlarged view showing a, pressing member, holding means and drive means included in the illustrative embodiment.

As shown in FIG. 2, the arms 40A and 40B each are generally L-shaped and pivotally supported by a shaft 44A or 44B at its bend portion. The shafts 44A and 44B are affixed to the printer body 100. The press rollers 2A and 2B are respectively rotatably supported by one end 401A and 401B of the arms 40A and 40B via shafts 45A and 45B. Rollers 46A and 46B are respectively rotatably mounted on the other ends 402A and 402B of the arms 40A and 40B. Tension springs 47A and 47B are respectively anchored to the above ends 402A and 402B at one end thereof, constantly biasing the arms 40A and 40B clockwise and exerting pressures on the print drums 1A and 1B, respectively. The other ends of the tension springs 47A and 47B are anchored to the printer body 100.

Figure 3:
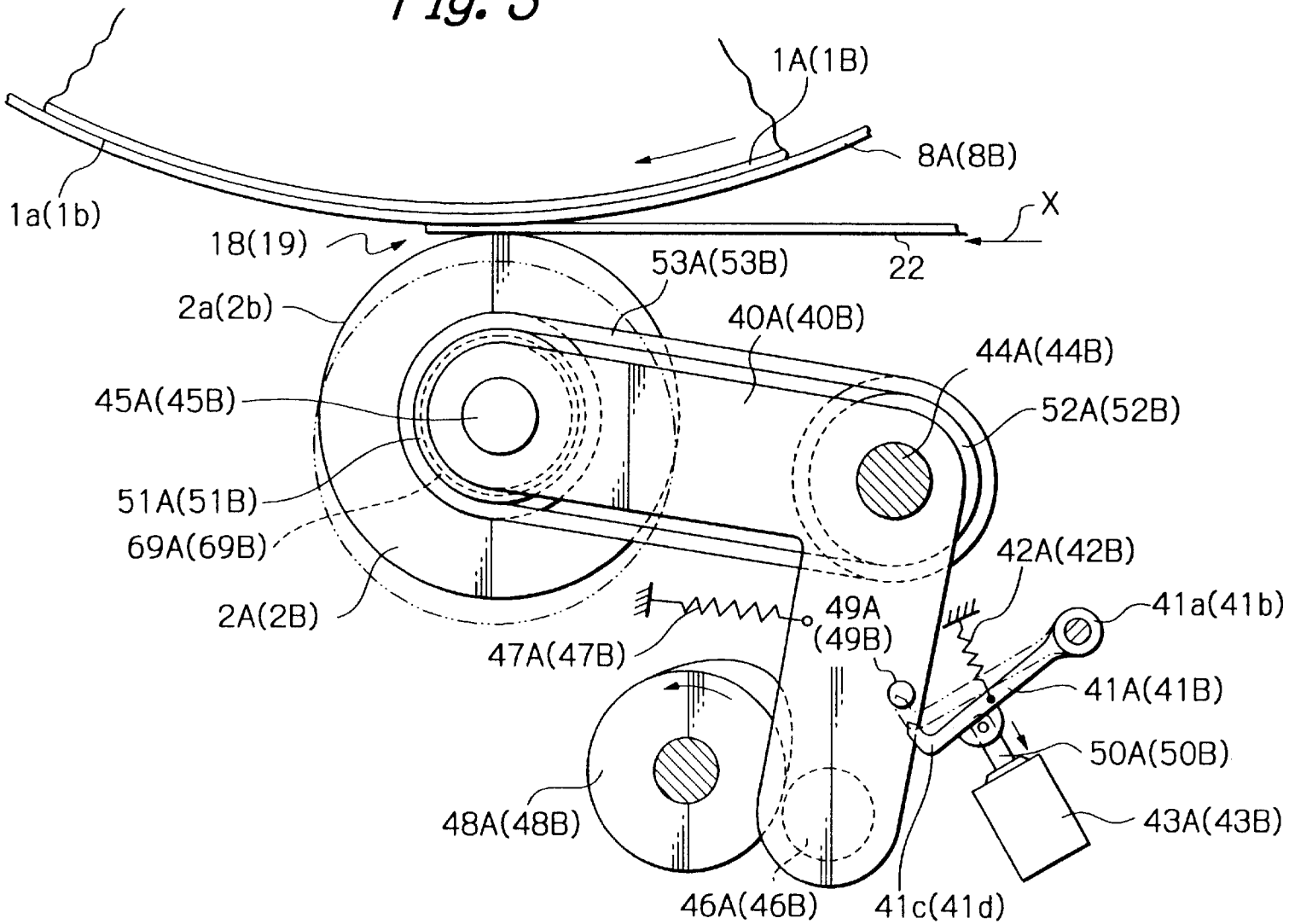
FIG. 3 is an enlarged view demonstrating the operation of the holding means and that of the pressing member.

The rollers 46A and 46B are respectively pressed against the contours of cams 48A and 48B. The cams 48A and 48B respectively move the outer circumferences 2*a* and 2*b* of the press rollers 2A and 2B into and out of contact with the outer circumferences 1*a* and 1*b* of the print drums 1A and 1B. The cams 48A and 48B are respectively rotated in synchronism with the print drums 1A and 1B via link mechanisms not shown. The cam 48A has a profile configured such that when the damper 9A passes the print position 18, the circumference 2*a* of the press roller 2A is spaced from the circumference 1*a* of the print drum 1A. The cam 48B has the same profile as the cam 48A except that it releases the circumference 2*b* of the press roller 2B from the circumference 1*b* of the print drum 1B when the damper 9B passes the print position 19. More specifically, the arm 40A is mounted on the shaft 44A in such a manner as to move the press roller 2A between a position where the roller 2A is spaced from the print drum 1A (FIG. 2; spaced position hereinafter) and a position where the former is pressed against the latter (solid line in FIG. 3). Likewise, the arm 40B is mounted on the shaft 44B in such a manner as to move the press roller 2B between a position where the roller 2B is spaced from the print drum 1B (FIG. 2) and a position where the former is pressed against the latter (solid line in FIG. 3). The press rollers 2A and 2B each press the paper 22 against the associated print drum 1A or 1B in order to transfer an image to the paper 22.

Pins 49A and 49B are studded on the arms 40A and 40B, respectively. As shown in FIG. 2, the stops 41A and 41B are located in the vicinity of the arms 40A and 40B, respectively, with their base ends 41*a* and 41*b* respectively angularly movably supported by the printer body 100. The stops 41A and 41B have free ends 41*c* and 41*d* thereof bent at substantially right angle. When the arms 40A and 40B move to release the press rollers 2A and 2B from the print drums 1A and 1B, respectively, the stops 41A and 41B abut against the pins 49A and 49B, respectively. A tension spring 42A is anchored at one end to the printer body 100 and at the other end to the stop 41A, constantly biasing the stop 41A toward the pin 49A. Likewise, a tension spring 42B is anchored at one end to the printer body 100 and at the other end to the stop 41B, constantly biasing the stop 41B toward the pin 49B.

The first and second solenoids 43A and 43B have plungers 50A and 50B, respectively, pinned to the stops 41A and 41B, respectively. The solenoids 43A and 43B are of the type pulling the plungers 50A and 50B, respectively, when energized. Specifically, when the solenoids 43A and 43B each are energized, it pulls the stop 41A or 41B against the action of the associated tension spring 42A or 42B from a catch position indicated by a dash-and-dots line in FIG. 3 to a release position indicated by a solid line in FIG. 3.

As shown in FIG. 2, pulleys 51A and 51B are respectively mounted on one side of the press rollers 2A and 2B via one-way clutches 69A and 69B. The one-way clutches 69A and 69B transfer rotation only from the pulleys 51A and 51B to the press rollers 2A and 2B, respectively. Double pulleys 52A and 52B are rotatably mounted on the shafts 44A and 44B, respectively. Belts 53A and 53B are respectively passed over the pulleys 51A and 51B and double pulleys 52A and 52B. A first and a second drive motor or drive means 54A and 54B have output shafts 55A and 55B, respectively, on which drive pulleys 56A and 56B are mounted. Drive belts 57A and 57B are respectively passed over the double pulleys 52A and 52B and drive pulleys 56A and 56B. The output shafts 55A and 55B of the drive motors 54A and 54B each are rotatable counterclockwise, as viewed in FIG. 2, under the control of the control means 80.

In the above construction, when the drive motor 54A or 54B is driven, it causes the associated press roller 2A or 2B to rotate counterclockwise, i.e., in a direction opposite from the direction in which the print drum 1A or 1B rotates during printing. When the press roller 2A or 2B is brought into contact with the associated print drum 1A or 1B while the drive motor 54A or 54B is deenergized, the press roller 2A or 2B is caused to rotate by the print drum 1A or 1B via the associated one-way clutch 69A or 69B.

Referring again to FIG. 1, the air sending means 6A is positioned at the right-hand side of the first print drum 1A. The air sensing means 6B is positioned between the first print drum 1A and the second print drum 1B. Further, the air sending means 6C is positioned at the left-hand side of the second print drum 1B. The air sending means 6A, 6B and 6C respectively have fans 58A, 58B and 58C for generating air streams, fan motors 59A, 59B and 59C, and paths 60A, 60B and 60C for respectively guiding air streams generated by the fans 58A, 58B and 58C to the vicinity of the print positions 18 and 19.

Figure 4:
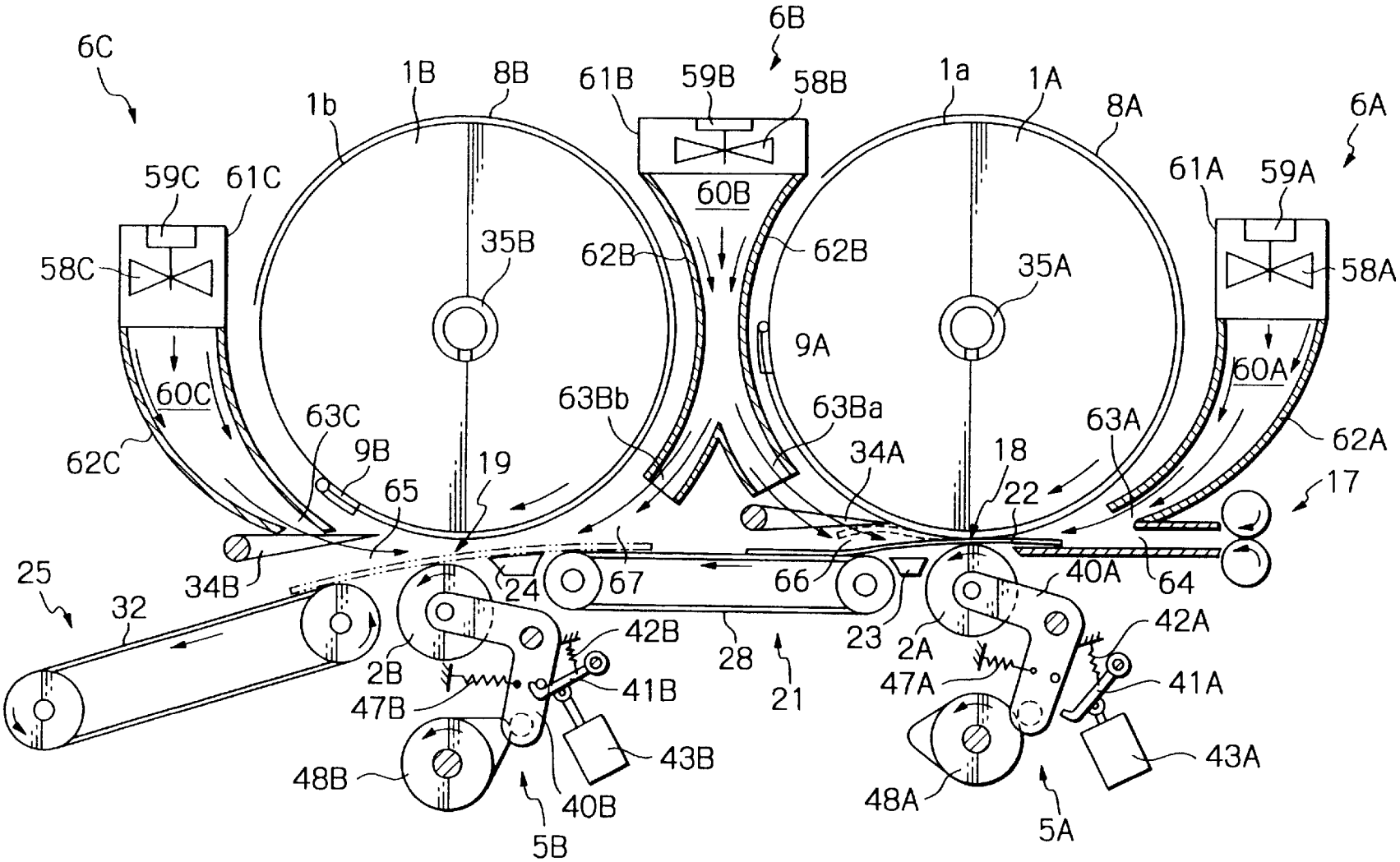
FIG. 4 is an enlarged view showing the construction and operation of air sending means and a specific condition wherein a first drum is selected.

As best shown in FIG. 4, the path 60A is formed by a duct 62A extending from a case 61A accommodating the fan 58A toward the print position 18. The duct 62A has an air outlet 63A at its lower end. This air outlet 63A faces a paper conveyance path 64 intervening between the registration roller pair 17 and the print position 18. Therefore, the air stream generated by the fan 58A is sent to the range between the above path 64 and the print position 18 from the upstream side in the direction of paper conveyance X. The path 60A has a sectional area sequentially decreasing toward the air outlet 63A in order to increase the flow rate of air around the air outlet 63A.

The path 60C is formed by a duct 62C extending from a case 61C accommodating the fan 58C toward the print position 19. The duct 62C has an air outlet 63C at its lower end. The air outlet 63C faces the upper surface of the peeler 34B and sends the air stream generated by the fan 58C to the range between a paper conveyance path 65 underlying the peeler 34B and the print position 19 from the downstream side. The path 60C also has a sectional area sequentially decreasing toward the air outlet 63C in order to increase the flow rate of the air stream around the air outlet 63C.

The path 60B is formed by a duct 62B extending from a case 61B accommodating the fan 58B toward the belt 28 of the conveyor 21. The duct 62B is bifurcated and has two air outlets 63B*a* and 63B*b* at its lower end. The air outlet 63B*a* faces the upper surface of the peeler 34A and sends the air stream generated by the fan 58B to the range between a paper conveyance path 66 extending between the peeler 34A and the belt 28 and the print position 18 from the downstream side. The other air outlet 63B*b* faces a paper conveyance path 67 formed by the belt 28 and guide 24 and sends the air stream generated by the fan 58B to the range between the above path 67 and the print position 19 from the upstream side in the direction X.

The ducts 62A through 62C are affixed to the printer body 100, and each has a width slightly greater than the axial length of associated one of the print drums 1A and 1B. The ducts 62A through 62C each are curved along the contours 1*a* or 1*b* of the adjoining print drum 1A or 1B and so positioned as not to contact the damper 9A or 9B when the print drum 1A or 1B rotates.

Figure 5:
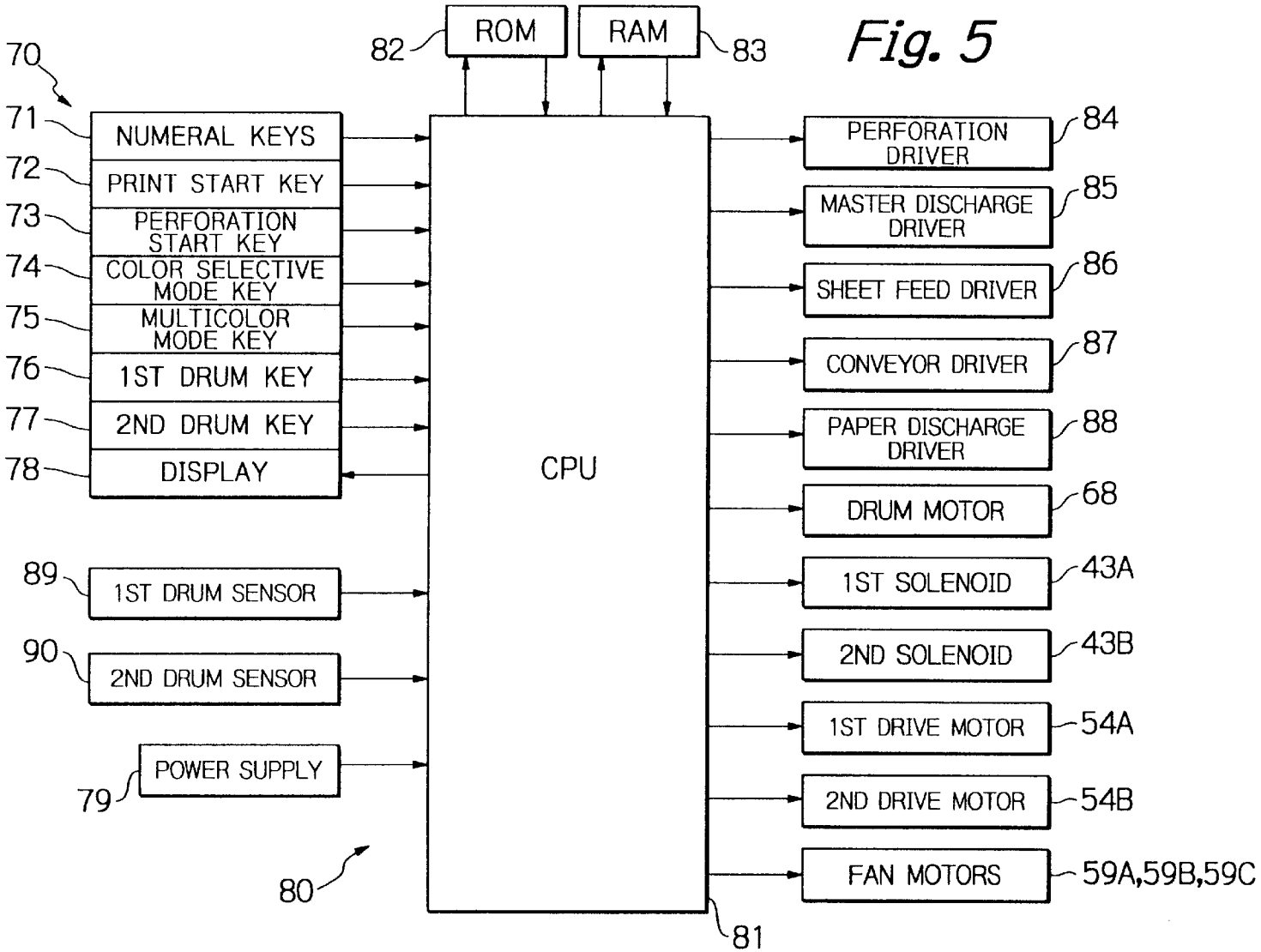
FIG. 5 is a block diagram schematically showing control means included in the illustrative embodiment.

As shown in FIG. 5, the illustrative embodiment includes a control panel 70 on which the following keys and display are arranged. Numeral keys 71 are used to input a desired number of prints. A print start key 72 is pressed to start producing a desired number of prints. A perforation start key 73 is pressed to start a sequence of steps of document reading, master making, master feeding, and master adhering. A color selective mode key 74 and a multicolor mode key 75, constituting print mode selecting means in combination, are pressed to select the color selective mode and multicolor mode, respectively. A first drum key 76 and a second drum key 77, constituting drum selecting means in combination, are pressed to select the first print drum 1A and second print drum 1B, respectively. A display 78, which is implemented by an LCD (Liquid Crystal Display), displays the number of prints input on the numeral keys 71, the number of remaining prints, drum selection information, print mode, and so forth.

The control means 80 is implemented by a conventional microcomputer including a CPU (Central Processing Unit) 81, a ROM (Read Only Memory) 82 and a RAM (Random Access Memory) 83 connected by a signal bus not shown. The various keys and display of the control panel 70 are connected to the CPU 81. Also connected to the CPU 81 are power supply 79, a perforation driver 84 for driving the master making devices 3A and 3B, a master discharge driver 85 for driving the master discharging devices 4A and 4B, a paper feed driver 86 for driving the pickup roller 11 and separator rollers 12 and 13, a conveyor driver 87 for driving the conveyor 21, and a paper discharge driver 88 for driving the paper discharging device 25. Further connected to the CPU 81 are the drum motor 68, first and second solenoids 43A and 43B, first and second drive motors 54A and 54B and fan motors 59A through 59C as well as a first and a second drum sensor or drum sensing means 89 and 90.

As shown in FIG. 1, the first and second drum sensors 89 and 90 are implemented by switches mounted on the print body 100 and facing the first and second print drums 1A and 1B, respectively. When the print drums 1A and 1B are mounted to the printer body 100, the sensors 89 and 90, respectively, turn on.

The ROM 82 stores the color selective mode, the multicolor mode, a first color mode and a second color mode belonging to the color selective mode, and a master making program beginning with the perforation of the stencil and ending with the adhesion of the master and triggered by the perforation start key 73. In addition, the ROM 82 stores a printing program triggered by the print start key 72 for repeating a printing cycle a number of times corresponding to the desired number of prints, a control program for controlling, based on the print modes, the positions and drive of the press roller 2A and 2B, the positions of the print drums 1A and 1B, and the air sending means 6A through 6C.

In the color selective mode, the printer executes the discharge of a used master and the feed of a new master with only one of the print drums 1A and 1B selected and executes printing with the drum 1A or 1B selected. Specifically, in the illustrative embodiment, when the color selective mode is selected, monocolor printing is effected by using either the print drum 1A or the print drum 1B. In the multicolor mode, the discharge of a used master and the feed of a new master are effected with both of the two print drums 1A and 1B, and multicolor printing is executed by using the two print drums 1A and 1B. Further, in the first color mode, the discharge of a used master and the feed of a new master are effected with the print drum 1A only, so that monocolor printing is performed with the print drum 1A. This is also true with the second color mode except that only the print drum 1B is used.

Figure 6:
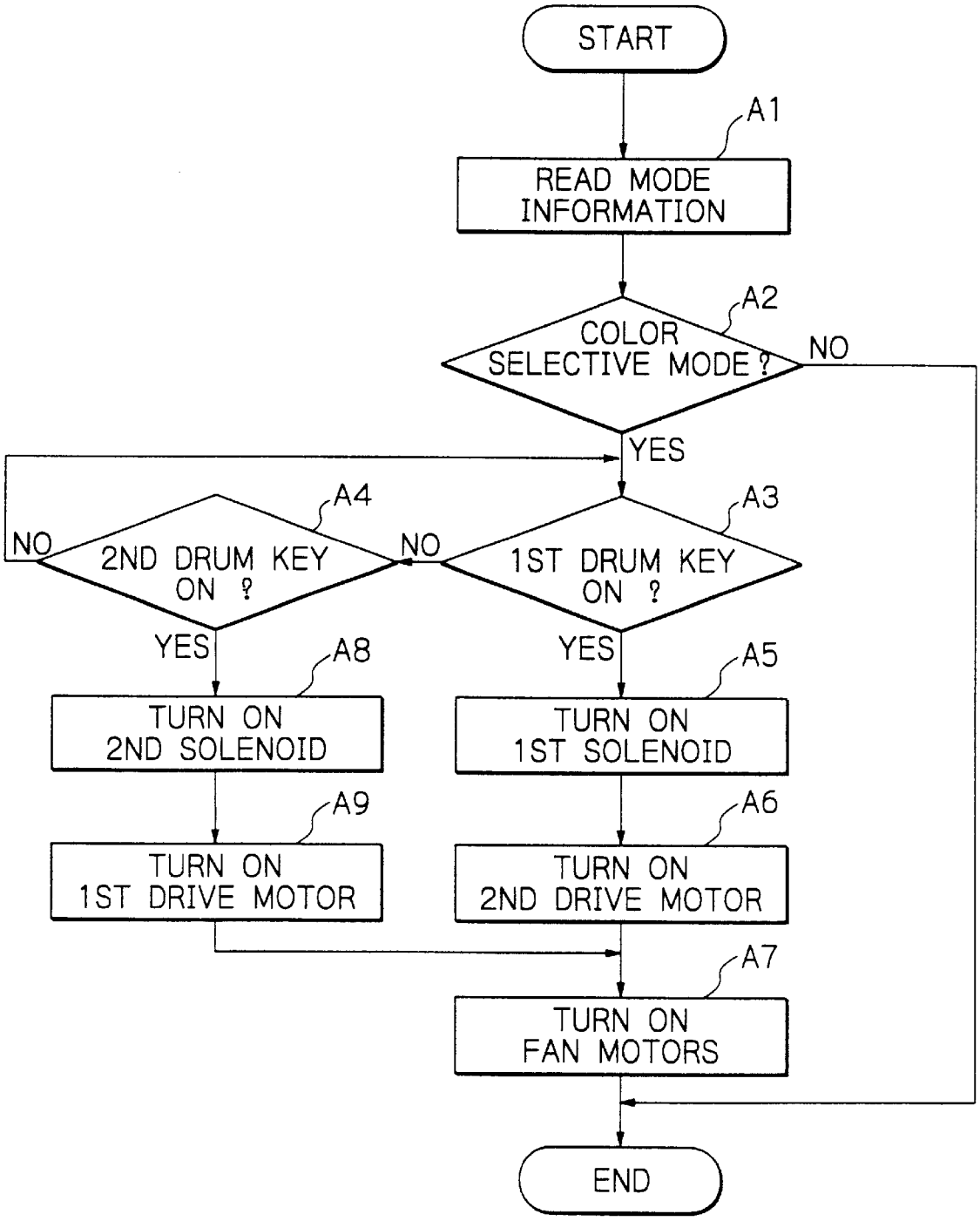
FIG. 6 is a flowchart demonstrating a specific control procedure available with the control means.
Figure 8:
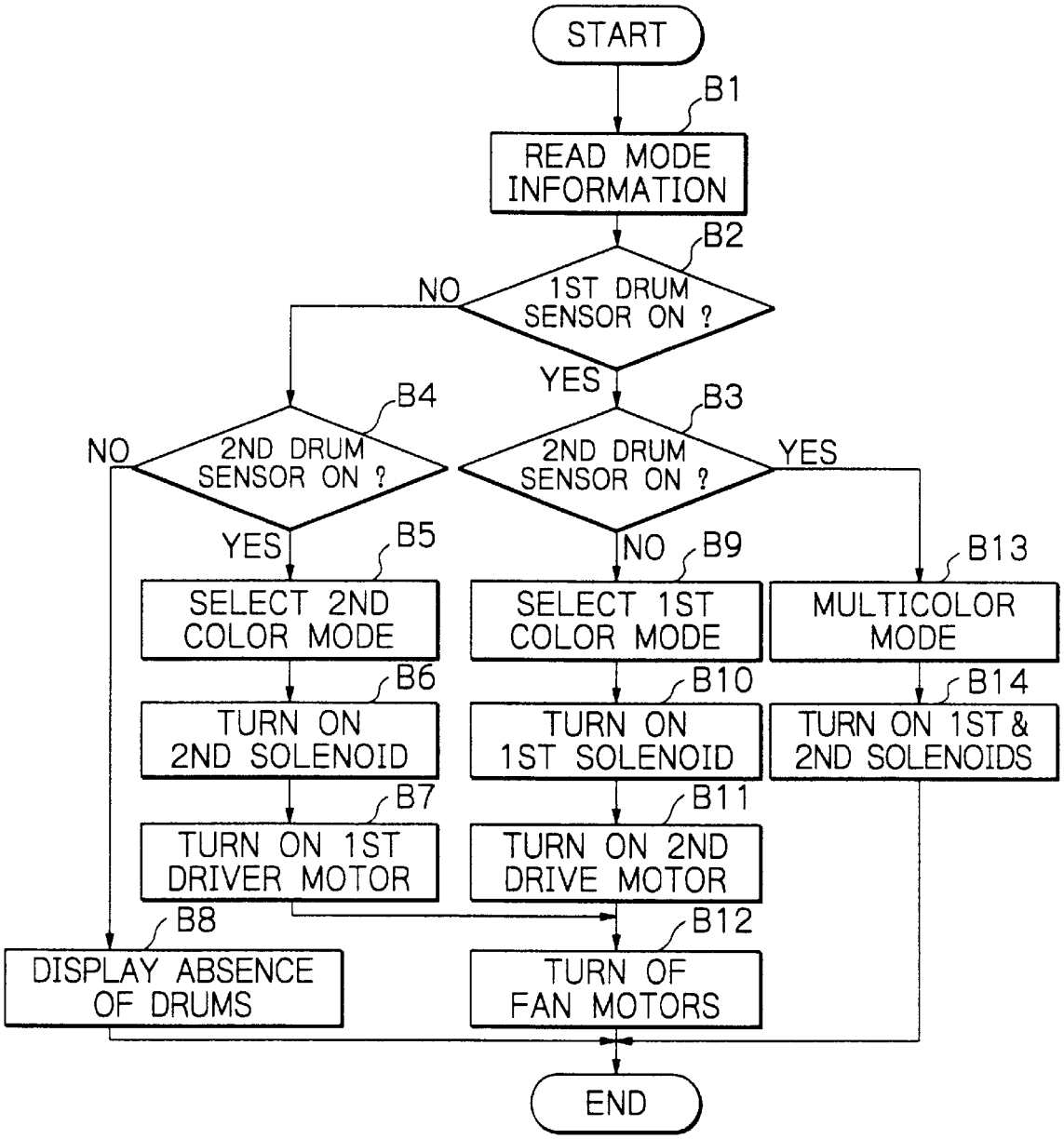
FIG. 8 is a flowchart showing another specific control procedure available with the control means.

Reference will be made to FIGS. 6 and 8 for describing a specific operation of the above printer, particularly control over the press rollers 2A and 2B and air sending means 6A through 6B executed by the controller 80 in each of the print modes.

First, the operator of the printer presses the color selective mode key 74 or the multicolor mode key 75 to select desired one of the color selective mode and multicolor mode. The operator then presses the first drum-key 76 or the second drum key 77 to designate the print drum 1A or 1B to use, and then presses the perforation start key 73. In response, the master making program starts to execute the master discharging, master making and master adhering steps. After the master adhering step, the operator presses the print start key 72, so that the printing program starts.

A procedure shown in FIG. 6 starts in parallel with the master making program or the printing program when the key 73 or 72, respectively, is pressed. As shown, the controller 80 reads print mode information input by the operator (step A1) and then determines a print mode (step A2). If the color selective mode is selected on the key 74 (Yes, step A2), the controller 80 advances to a step A3 the answer of the step A2 is No, the controller 80 ends the procedure, determining that the multicolor mode is selected.

The controller 80 determines the statuses of the first drum key 76 and second drum key 77 (steps A3 and A4). If the first drum key 76 is in an ON state (Yes, step A3), the controller 80 determines that the first print drum 1A is selected, turns on the first solenoid 43A (step A5), turns on the second drive motor 54B (step A6), turns on the fan motors 59A through 59C (step A7), and ends the procedure.

When the solenoid 43A is energized, the stop 41A is brought to the release position shown in FIG. 4 and allows the arm 40A to rotate clockwise due to the action of the tension spring 47A. As a result, the press roller 2A is brought to the contact position where it is pressed against the print drum 1A. When the second drive motor 54B is turned on, the press roller 2B rotated counterclockwise, as viewed in FIG. 4. The fan motors 59A through 59C respectively cause the fans 58A through 58C to rotate when turned on, thereby generating air streams. The air streams from the fans 58A through 58C are respectively sent to the vicinity of the print positions 18 and 19 via the paths 60A through 60C and air outlets 63A, 63B*a*, 63B*b* and 63C.

On the other hand, when the second drum key 77 is pressed (Yes, step A4), the controller 80 advances to step A8, determining that the second print drum 1B is selected. The controller 80 turns on the second solenoid 43B (step A8), turns on the first drive motor 54A (step A9), and turns on the fan motors 59A through 59C (step A7).

Figure 7:
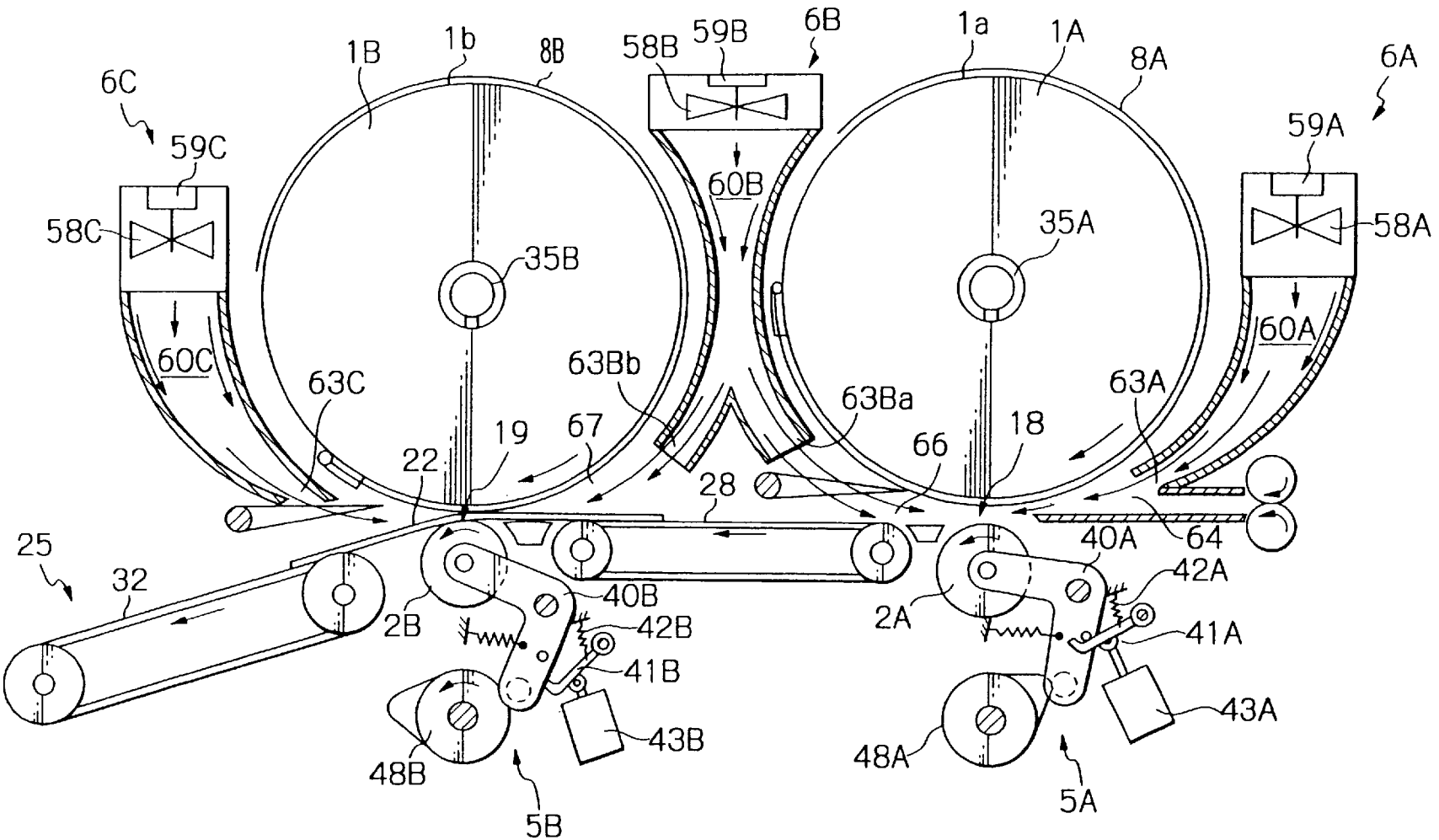
FIG. 7 is an enlarged view showing another specific condition in which a second ink drum is selected.

When the solenoid 43B is energized, the stop 41B is brought to the release position shown in FIG. 7 and allows the arm 40B to rotate clockwise due to the action of the tension spring 47B. As a result, the press roller 2B is pressed against the print drum 1B. When the first drive motor 54A is turned on, the press roller 2A rotated counterclockwise, as viewed in FIG. 7. The fan motors 59A through 59C respectively cause the fans 58A through 58C to rotate when turned on, thereby generating air streams. The air streams from the fans 58A through 58C are respectively sent to the vicinity of the print positions 18 and 19 via the paths 60A through 60C and air outlets 63A, 63B*a*, 63B*b* and 63C.

More specifically, when the print drum 1A is selected, the holding means 5B holds the press roller 2B associated with the other print drum 1B in the spaced position spaced from the drum 1B. When the print drum 1B is selected, the holding means 5A holds the press roller 2A associated with the other print drum 1A in the spaced position spaced from the drum 1A. It is therefore not necessary to wrap a non-perforated stencil around the print drum 1A or 1B not selected, so that the print cost is reduced. In addition, the printer allowing the operator to select desired one of the print drums 1A and 1B is convenient to use.

Assume that the print drum 1A is selected. Then, when the printing program starts and causes the paper 22 to be fed in FIG. 4, the press roller 2A presses the paper 22 being conveyed via the print position 18. As a result, an image is transferred from the master 8A wrapped around the print drum 1A to the paper 22. When the leading edge of the paper 22 arrives at the paper conveyance path 66, the fan 58B sends an air stream toward the leading edge of the paper 22 from above via the air outlet 63B*a*. The air stream, coupled with the stiffness of the paper 22, causes the paper 22 to separate from the circumference 1*a* of the print drum 1A before reaching the peeler 34A. This successfully prevents the paper 22 from noticeably rolling up. The air stream being sent via the air outlet 63B*a* guides the leading edge of the paper 22 separated from the print drum 1A toward the belt 28. The belt 28 conveys the paper 22 toward the print position 19 while retaining it thereon by suction. Even when the paper 22 is not stiff or when ink is deposited on the paper 22 in an excessive amount and causes the paper 22 to closely adhere to the print drum 1A, the peeler 34A and air stream being sent via the air outlet 63B*a* cooperate to separate the leading edge of the paper 22 from the drum 1A.

When the paper 22 being conveyed by the belt 28 in the direction X approaches the print position 19, an air stream being sent from the air outlet 63B*b* forces the paper 22 against the press roller 2B that is rotating at the spaced position. Further, an air stream is sent via the air outlet 63C in the vicinity and downstream of the print position 19, forcing the paper 22 against the press roller 22 even after the paper 22 has moved away from the print position 19.

In the above condition, the rotation of the press roller 2B is successfully transferred to the paper 22 despite that the paper 122 is not nipped between the press roller 2B and the print drum 1B. The paper 22 can therefore be conveyed by a sufficient force without defective conveyance or a jam. The paper 22 moved away from the print position 19 is conveyed by the belt 32 to the tray 20, FIG. 1, while being subjected to the air stream being sent via the air outlet 63C.

Assume that the second print drum 1B is selected. Then, at positions upstream and downstream of the print position 18, the air streams being sent via the air outlets 63A and 63B*a*, respectively, act on the paper 22 being conveyed via the print position 18. As a result, the paper 22 is forced against the press roller 2A rotating at the spaced position. It follows that the rotation of the press roller 2A is transferred to the paper 22 despite that the press roller 2A and print drum 1A do not nip the paper 22. This is successful to obviate defective conveyance and jam ascribable to a short conveying force.

The belt 28 conveys the paper 22 moved away from the print position 18 to the print position 19. At the print position 19, the press roller 2B presses the paper 22 with the result that an image is transferred from the master 8B wrapped around the print drum 18 to the paper. The paper 22 moved away from the print position 19 is sucked onto the belt 32 while being subjected to the air stream being sent from the air outlet 63C and driven out to the tray 20, FIG. 1.

On the other hand, in the multicolor mode, the press rollers 2A and 2B press the paper 22 at the print positions 18 and 19, respectively. Consequently, images are transferred from the masters 8A and 8B wrapped around the print drums 1A and 1B, respectively, to the paper 22 one above the other. The paper 22 with the resulting multicolor image is driven out to the tray 20.

In the illustrative embodiment, automatic print mode switching is also available on the basis of the presence/absence of the print drums 1A and 1B, as will be described with reference to FIGS. 8 and 9 hereinafter. As shown in FIG. 8, the controller 80 reads information output from the first and second drum sensors 89 and 90 (step B1). If the drum sensor 89 is in an ON state (Yes, step B2), the controller 80 determines that the print drum 1A is present on the printer body 100, and then determines the status of the drum sensor 90 (step B3). If the answer of the step B2 is No, the controller 80 determines that the print drum 1A is not mounted to the printer body 100, and then determines the status of the drum sensor 90 (step B4).

If the answer of the step B4 is Yes, the controller 80 determines that only the print drum 1B is present on the printer body 100, and advances to step B5. In the step B5, the controller 80 automatically selects the second color mode for printing an image with the print drum 1B and then executes the master making program and printing program in response to the operation of the perforation start key 73 and print start key 72. Subsequently, the controller 80 energizes the second solenoid 43B (step B6), energizes the first drive motor 54A (step B7), energizes the fan motors 59A through 59C (step B12), and ends the control.

If the drum sensor 90 is in an OFF state (No, step B4), the controller 80 determines that neither the print drum 1A nor the print drum 1B is present on the printer body 100. The controller 80 then informs the operator of the absence of the print drums 1A and 1B via the display 78 (step B8). In this case, the controller 80 does not execute the master making program or the printing program, i.e., stops the entire operation even when the operator presses the perforation start key 73 or the print start key 72.

If the drum sensor 90 is in an ON state (Yes, step B3), the controller 80 determines that both the print drum 1A and print drum 1B are present on the printer body 100, and then automatically selects the multicolor mode (step B13). The controller 80 then turns on the first and second solenoids 43A and 43B (step B14) while executing the master making program and printing, program. In the multicolor mode, the press rollers 2A and 2B are brought into contact with the print drums 1A and 1B, respectively. In this condition, images are transferred from the masters 8A and 8B wrapped around the print drums 1A and 1B, respectively, to the paper 22 fed from the tray 10 at the print positions 18 and 19. As a result, a multicolor image is printed on the paper 22.

If the drum sensor 90 is in an OFF state (No, step B3), the controller 80 determines that only the print drum 1A is present on the printer body 100. The controller 80 then selects the first color mode (step B9) and executes the master making program and printing program in response to the operation of the perforation start key 73 and print start key 72. Further, the controller 80 turns on the solenoid 43A (step B10), turns on the drive motor 54B (step B11), and turns on the fan motors 59A through 59C (step B12).

In the first color mode, the press roller 2B cooperative with the unused print drum, i.e., the print drum 1B absent on the printer body 100 is held at the spaced position by the holding means 5B while being rotated. The air streams being generated by the fans 58A through 58C are sent to the vicinity of the print positions 18 and 19 via the paths 60A through 60C and air outlets 63A through 63C.

In the second color mode, the press roller 2A cooperative with the unused print drum, i.e., the print drum 1A absent on the printer body 100 is held at the spaced position by the holding means 5A while being rotated. The air streams being generated by the fans 58A through 58C are sent in the same manner as in the first color mode.

Figure 9:
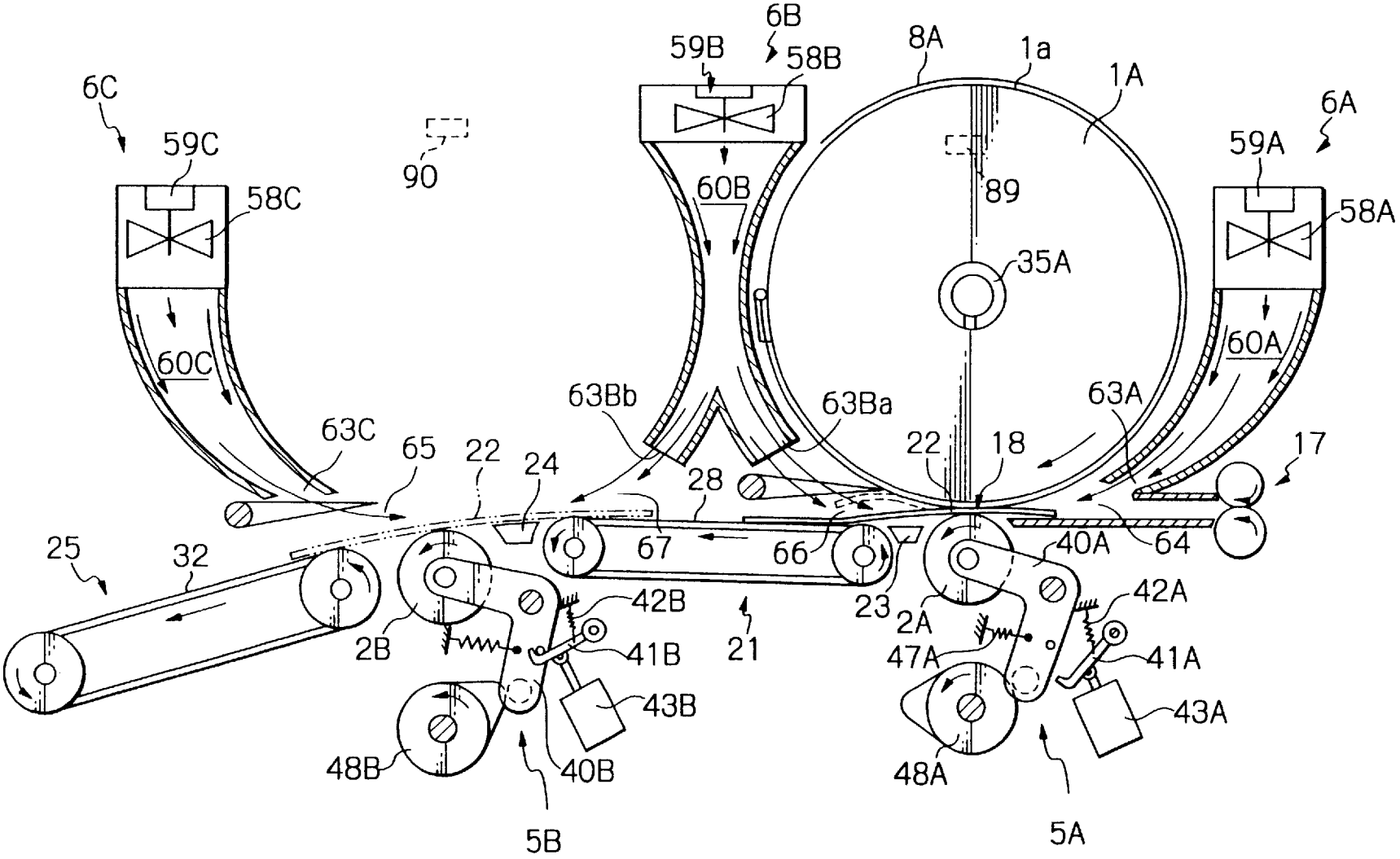
FIG. 9 is an enlarged view showing how the illustrative embodiment operates when one of the two print drums is absent.

FIG. 9 shows a specific condition wherein the second print drum 1B is absent on the printer body 100. In this condition, the first color mode is automatically selected. If the first print drum 1A is absent, the second color mode is automatically selected. The operator therefore does not have to care whether or not the print drums 1A and 1B are present on the printer body 100. This successfully obviates the operator's erroneous operation.

In the first color mode, the paper 22 with an image printed thereon at the print position 18 is conveyed to the downstream side. In the vicinity of the print position 19, the air streams being sent via the air outlets 63B*b* and 63C force the paper 22 against the press roller 2B being rotated. This insures a sufficient conveying force despite the absence of the print drum 1B and thereby surely obviates defective conveyance and jam ascribable to a short conveying force.

In the second color mode, in the vicinity of the print position 18, the air streams being sent via the air outlets 63A and 63B*a* force the paper 22 against the press roller 2A being rotated. This also insures a sufficient conveying force despite the absence of the print drum 1A and thereby surely obviates defective conveyance and jam ascribable to a short conveying force.

Figure 10:
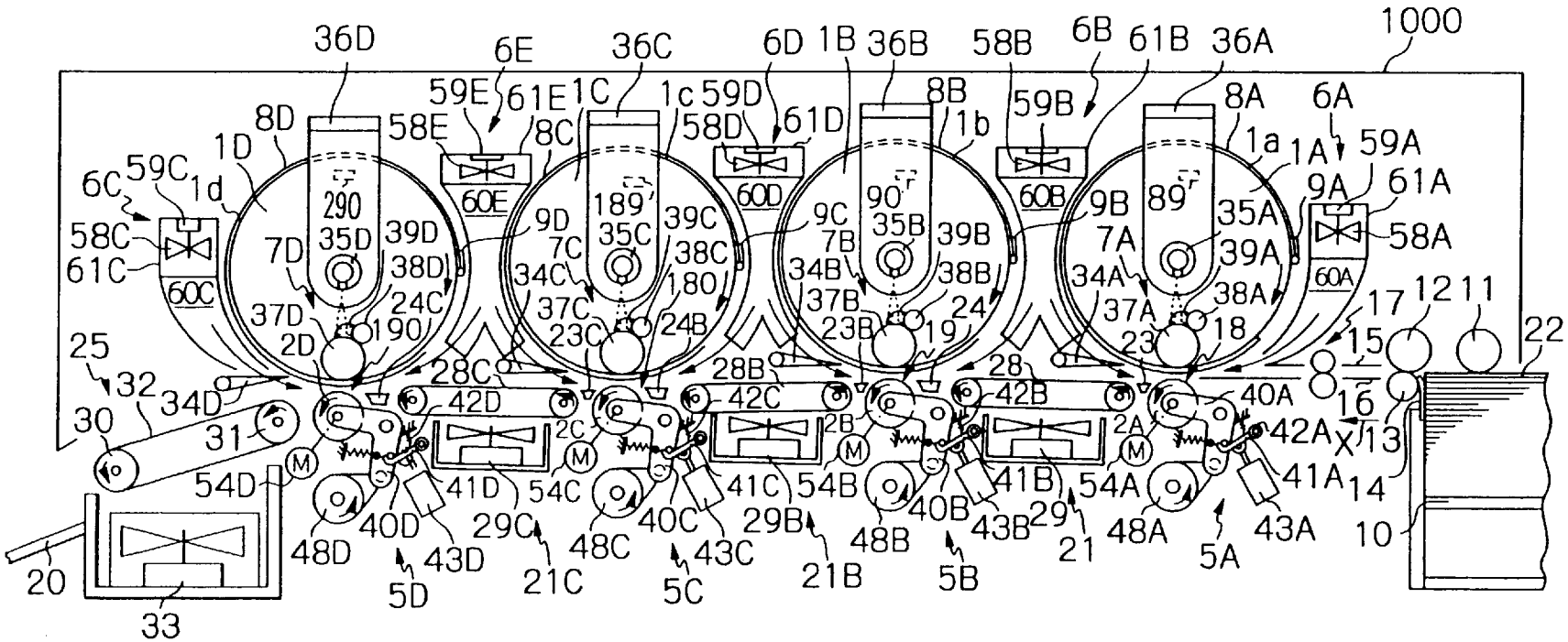
FIG. 10 is a view showing an alternative embodiment of the present invention.

Referring to FIG. 10, an alternative embodiment of the multicolor stencil printer in accordance with the present invention will be described. As shown, the printer includes four parallel print drums, i.e., first to fourth print drums 1A, 1B, 1C and 1D arranged in parallel in this order from the upstream side to the downstream side in the direction of paper conveyance X within a printer body 1000. The print drums 1A through 1D each store ink of a particular color thereinside. Four press rollers 2A, 2B, 2C and 2D are also accommodated in the printer body 1000 and movable into and out of contact with the print drums 1A through 1D, respectively. The printer is selectively operable in a multicolor mode or a color selective mode, as desired. In the multicolor mode, the print drums 1A through 1D and press drums 2A through 2D respectively cooperate to nip the paper 22 for printing a multicolor image thereon. In the color selective mode, the print drum 1A and press roller 2A, the print drum 1B and press roller 2B, the print drum 1C and press roller 2C or the print drum 1D and press roller 2D nip the paper 22 for printing an image thereon in a desired color. Control means 80 (see FIG. 14) sets up either the multicolor mode or the color selective mode, as desired.

In the illustrative embodiment, holding means 5A, 5B, 5C and 5D and air sending means 6A, 6B, 6C, 6D and 6E are arranged around the first to fourth print drums 1A through 1D, respectively. The holding means 5A through 5D respectively hold the press rollers 2A through 2D at spaced positions spaced from the outer circumferences 1*a* through 1*d* of the print drums 1A through 1D. Ink feeding means 7A, 7B, 7C and 7D are arranged within the print drums 1A through 1D, respectively. The illustrative embodiment, like the previous embodiment, additionally includes conventional master making devices and master discharging devices although not shown specifically.

The print drums, press rollers, holding means, air sending means and ink feeding means of the illustrative embodiment are substantially identical in construction and operation with those of the previous embodiment and simply distinguished by suffixes A, B, C, D and E. The following description will concentrate mainly on arrangements relating to the third and fourth print drums 1C and 1D and configurations unique to this embodiment in order to avoid redundancy.

Yellow ink and magenta ink are respectively fed to the drums 1A and 1B from respective ink packs, not shown, via the drum shafts 35A and 35B. Likewise, cyan ink and black ink are respectively fed to the drums 1C and 1D from respective ink packs, not shown, via drum shafts 35C and 35D.

The third and fourth print drums 1C and 1D are rotatably mounted on the drum shafts 35C and 35D, respectively. Frames 36C and 36D are removably mounted on the printer body 100 and support opposite ends of the drum shafts 35C and 35D, respectively. The print drums 1C and 1D are interconnected by a gear train, a belt and pulley device or similar conventional power transmission mechanism. A drum motor 68 (see FIG. 14) is drivably connected to the power transmission mechanism in order to cause the print drums 1C and 1D to rotate in the clockwise direction, as viewed in FIG. 10, or printing direction in synchronism with the print drums 1A and 1B. The control means 280 controls the drum motor 68 in order to control the speed and direction of rotation of the print drums 1A through 1D. Specifically, the print drums 1C and 1D each are rotated clockwise at a higher speed during printing than during the interval between the master feeding operation and the master adhering operation. Masters 8C and 8D are wrapped around the print drums 1C and 1D, respectively.

The press roller 2C and print drum 1C define a print position 180 therebetween while the press roller 2D and print drum 1D define a print position 190 therebetween. A conveyor 21B identical with the conveyor 21 extends between the two print positions 19 and 180 and forms a paper conveyance path between the print drums 1B and 1C. Guides 23B and 24B respectively precede and follow the conveyor 21B. Also, a conveyor 21C identical with the conveyor 21 extends between the two print positions 180 and 190 and forms a paper conveyance path between the print drums 1C and 1D. Guides 23C and 24C respectively precede and follow the conveyor 21C. In the illustrative embodiment, the paper discharging device 25 is interposed between the print position 190 and the print tray 20.

The conveyors 21B and 21C respectively include belts 28B and 28C and suction fans 29B and 29C positioned below the belts 28B and 28C, respectively. The conveyors 21B and 21C are respectively configured to convey the paper 22 coming out of the print position 19 and 180 to the downstream side in the direction X, i.e., the print positions 180 and 190 while retaining the paper 22 on the belts 28B and 280 by suction.

Peelers 34C and 34D are respectively positioned above the conveyor 21C and paper discharging device 25 in order to remove the paper 22 from the circumferences 1*c* and 1*d* of the print drums 1C and 1D. The peelers 34C and 34D each have a comb-like configuration and extend in the widthwise direction of the paper 22. The air sending means 6E and 6C respectively send air toward positions around the print positions 180 and 190.

The holding means 5C includes an arm 40C supporting the press roller 2C such that the roller 2C is movable into and out of contact with the print drum 1C. A stop 41C is engageable with the arm 40C. A tension spring or biasing means 42C constantly biases the stop 41C in a direction in which the stop 41C engages with the arm 40C. A third electromagnetic solenoid or actuator 43C moves the stop 41C away from the arm 40C. Likewise, the holding means 5D includes an arm 40D supporting the press roller 2D such that the roller 2D is movable into and out of contact with the print drum 1D. A stop 41D is engageable with the arm 40D. A tension spring or biasing means 42D constantly biases the stop 41D in a direction in which the stop 41D engages with the arm 40D. A fourth electromagnetic solenoid or actuator 43D moves the stop 41D away from the arm 40D.

Figure 11:
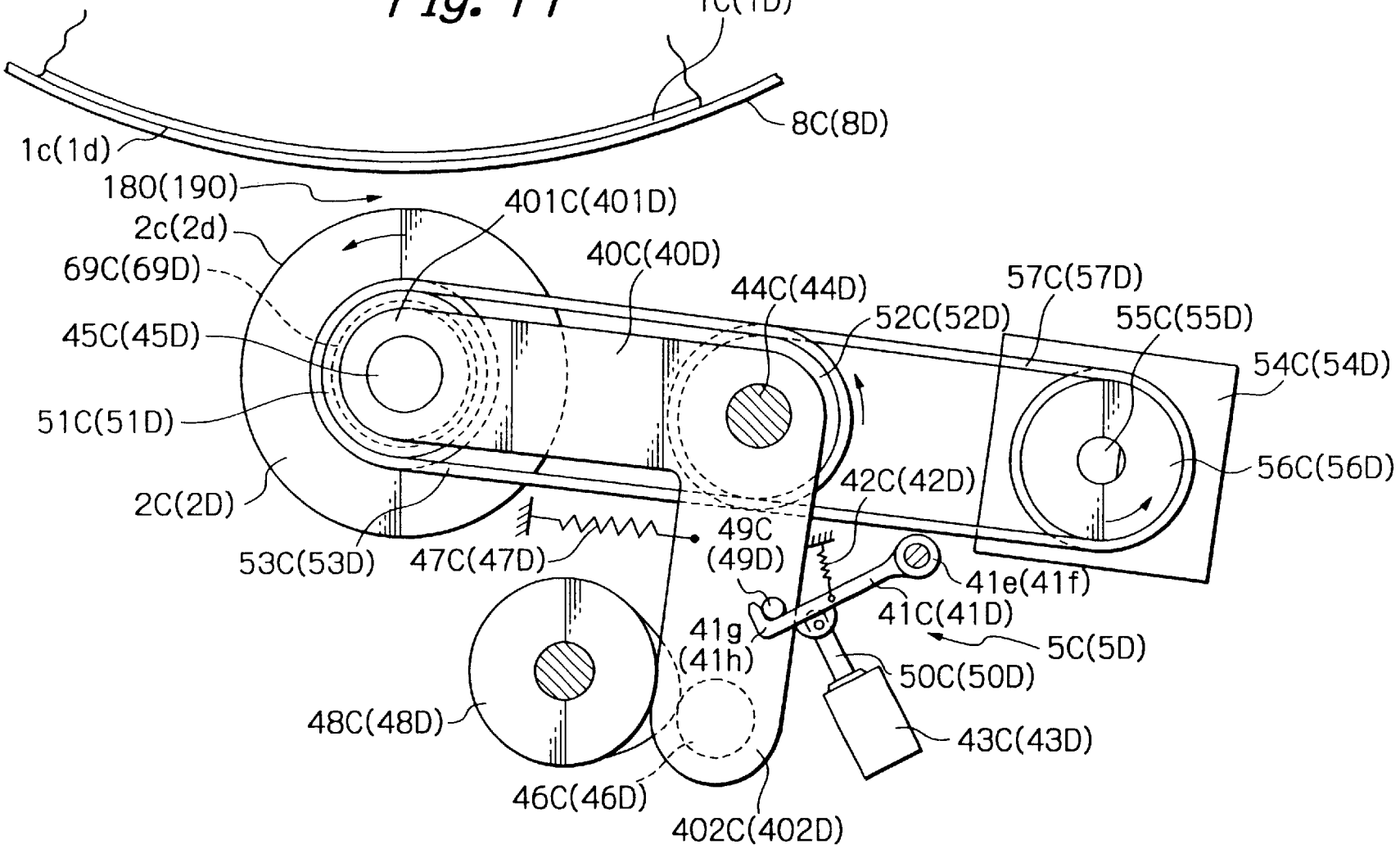
FIG. 11 is an enlarged view showing a pressing member, holding means and drive means assigned to each of a third and a fourth print drum included in the alternative embodiment.

As shown in FIG. 11, the arms 40C and 40D each are generally L-shaped and pivotally supported by a shaft 44C or 44D at its bend portion. The shafts 44C and 44D are affixed to the printer body 1000. The press rollers 2C and 2D are respectively rotatably supported by one end 401C and 401D of the arms 40C and 40D via shafts 45C and 45D. Rollers 46C and 46D are respectively rotatably mounted on the other ends 402C and 402D of the arms 40C and 40D. Tension springs 47C and 47D are respectively anchored to the above ends 402C and 402D at one end thereof, constantly biasing the arms 40C and 40D clockwise and exerting pressures on the print drums 1C and 1D, respectively. The other ends of the tension springs 47C and 47D are anchored to the printer body 1000.

The rollers 46C and 46D are respectively pressed against the contours of cams 48C and 48D. The cams 48C and 48D respectively move the outer circumferences 2*c* and 2*d* of the press rollers 2C and 2D into and out of contact with the outer circumferences 1*c* and 1*d* of the print drums 1C and 1D. The cams 48C and 48D are respectively rotated in synchronism with the print drums 1C and 1D via link mechanisms not shown. The cam 48C has a profile configured such that when a damper 9C passes the print position 180, the circumference 2*c* of the press roller 2C is spaced from the circumference 1*c* of the print drum 1C. The cam 48D has the same profile as the cam 48C except that it releases the circumference 2*d* of the press roller 2D from the circumference 1*d* of the print drum 1D when a clamper 9D passes the print position 190. More specifically, the arm 40C is mounted on the shaft 44C in such a manner as to move the press roller 2C between the spaced position spaced from the print drum 1C and the contact position contacting the print drum 1C. Likewise, the arm 40D is mounted on the shaft 44D in such a manner as to move the press roller 2D between the spaced position spaced from the print drum 1D and the contact position contacting the drum 1D. The press rollers 2C and 2D each press the paper 22 against the associated print drum 1C or 1D in order to transfer an image to the paper 22.

Pins 49C and 49D are studded on the arms 40C and 40D, respectively. As shown in FIG. 11, the stops 41C and 41D are located in the vicinity of the arms 40C and 40D, respectively, with their base ends 41*e* and 41*f* respectively angularly movably supported by the printer body 1000. The stops 41C and 41D have free ends 41*g* and 41*h* thereof bent at substantially right angle. When the arms 40C and 40D move to release the press rollers 2C and 2D from the print drums 1C and 1D, respectively, the stops 41C and 41D abut against the pins 49C and 49D, respectively. A tension spring 42C is anchored at one end to the printer body 1000 and at the other end to the stop 41C, constantly biasing the stop 41C toward the pin 49C. Likewise, a tension spring 42D is anchored at one end to the printer body 1000 and at the other end to the stop 41D, constantly biasing the stop 41D toward the pin 49D.

The third and fourth solenoids 43C and 43D have plungers 50C and 50D, respectively, pinned to the stops 41C and 41D, respectively. The solenoids 43C and 43D are of the type pulling the plungers 50C and 50D, respectively, when energized. Specifically, when the solenoids 43C and 43D each are energized, it pulls the stop 41C or 41D against the action of the associated tension spring 42C or 42D from the catch position to the release position.

As shown in FIG. 11, pulleys 51C and 51D are respectively mounted on one side of the press rollers 20 and 2D via one-way clutches 69C and 69D. The one-way clutches 690 and 69D transfer rotation only from the pulleys 51C and 51D to the press rollers 2C and 2D, respectively. Double pulleys 52C and 52D are rotatably mounted on the shafts 44C and 44D, respectively. Belts 53C and 53D are respectively passed over the pulleys 51C and 51D and double pulleys 52C and 52D. A third and a fourth drive motor or drive means 54C and 54D have output shafts 55C and 55D, respectively, on which drive pulleys 56C and 56D are mounted. Drive belts 57C and 57D are respectively passed over the double pulleys 52C and 52D and drive pulleys 56C and 56D. The output shafts 55C and 55D of the drive motors 54C and 54D each are rotatable counterclockwise, as viewed in FIG. 11, under the control of the control means 280.

In the above construction, when the drive motor 54C or 54D is driven, it causes the associated press roller 2C or 2D to rotate counterclockwise, i.e., in a direction opposite to the direction in which the print drum 1C or 1D rotates during printing. When the press roller 2C or 2D is brought into contact with the associated print drum 1C or 1D while the drive motor 54C or 54D is deenergized, the press roller 2C or 2D is caused to rotate by the print drum 1C or 1D via the associated one-way clutch 69C or 69D.

Referring again to FIG. 10, the air sending means 6D is positioned between the second and third print drums 1B and 1C while the air sending means 6E is positioned between the third and fourth drums 1C and 1D. The air sending means 6C is positioned at the left-hand side of the print drum 1D. The air sending means 6D, 6E and 6C respectively have fans 58D, 58E and 58C for generating air streams, fan motors 59D, 59E and 59C, and paths 60D, 60E and 60C for respectively guiding air streams generated by the fans 58D, 58E and 58C to the vicinity of the print positions 19, 180 and 190.

Figure 12:
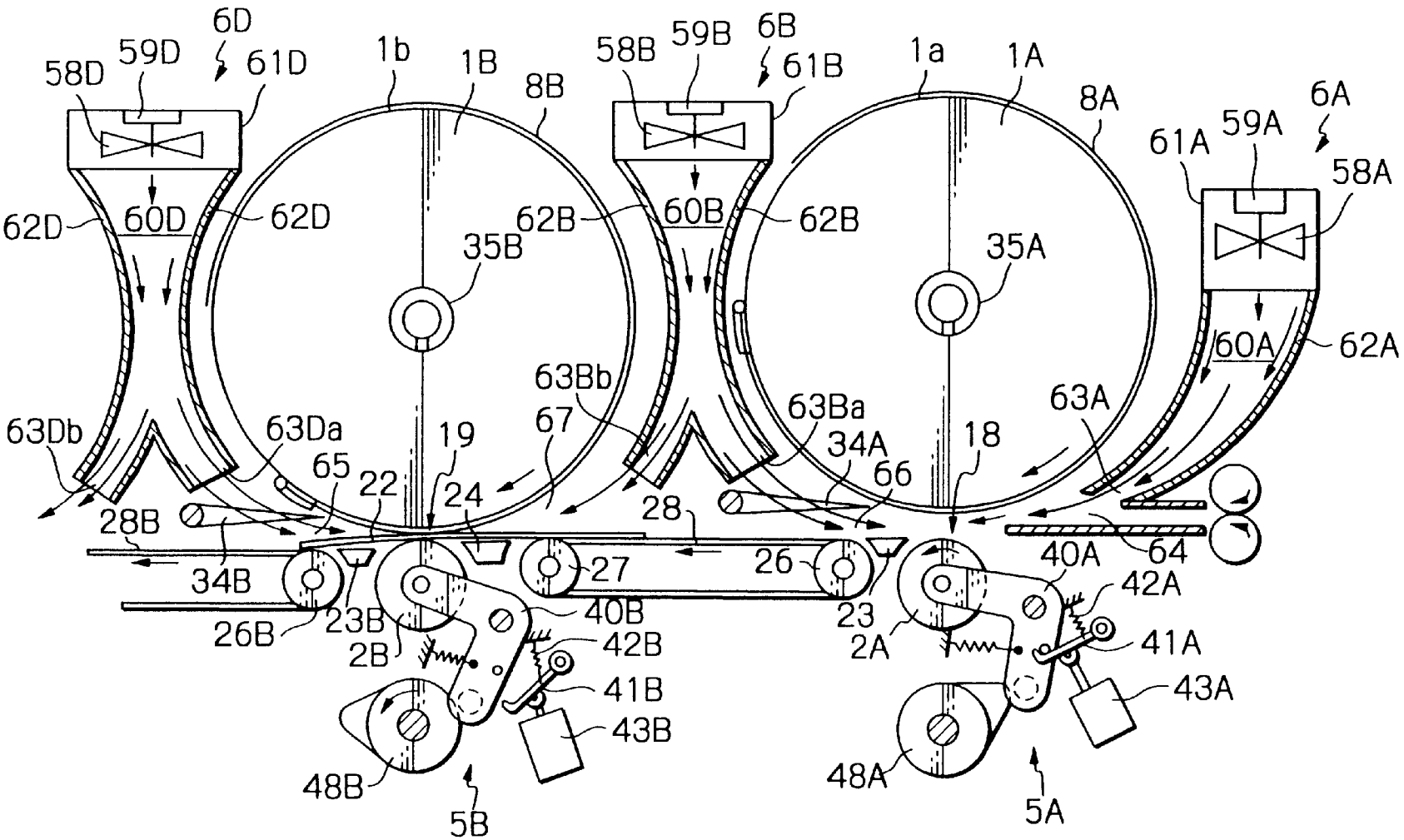
FIG. 12 is an enlarged view showing arrangements around the first and second drums included in the alternative embodiment.
Figure 13:
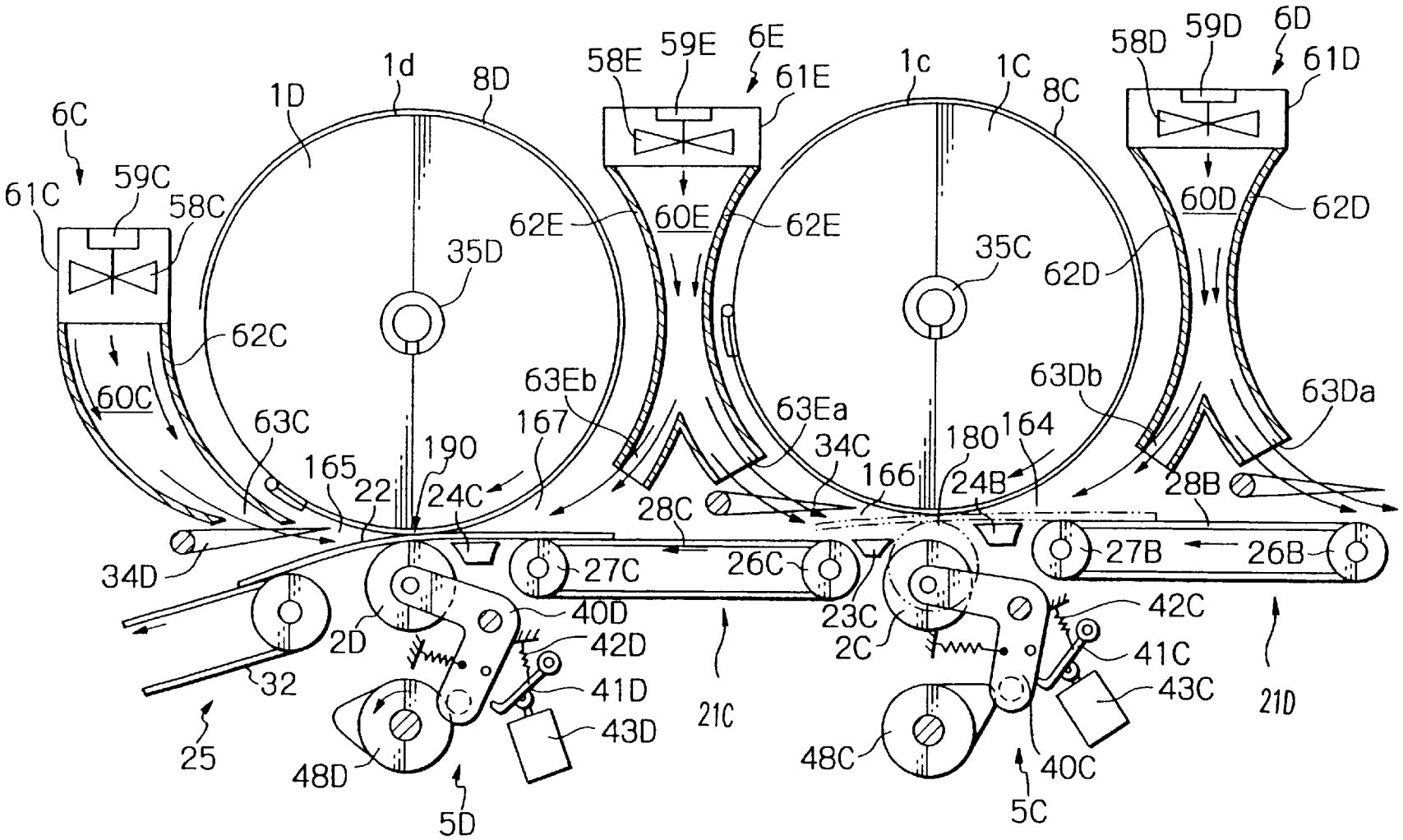
FIG. 13 is an enlarged view showing arrangements around the third and fourth drums included in the alternative embodiment.

As shown in FIGS. 12 and 13, the path 60D is formed by a duct 62D extending from a case 61D accommodating the fan 58D toward the belt 28B of the conveyor 21B. The conveyor 21B includes a drive roller 26B and a driven roller 27B. The duct 62D is bifurcated and has two air outlets 63D*a* and 63D*b* at its lower end. The air outlet 63D*a* faces the upper surface of the peeler 34B and sends the air stream generated by the fan 58D to the range between a paper conveyance path 65 extending between the peeler 34B and the belt 28B and the print position 19 from the downstream side. The other air outlet 63D*b* faces a paper conveyance path 164 formed by the belt 28B and guide 24B and sends the air stream generated by the fan 58D to the range between the above path 164 and the print position 180 from the upstream side in the direction X.

The path 60E is formed by a duct 62E extending from a case 61E accommodating the fan 58E toward the belt 28C of the conveyor 21C. The conveyor 21C includes a drive roller 26C and a driven roller 27C. The duct 62E is bifurcated and has two air outlets 63E*a* and 63E*b* at its lower end. The air outlet 63E*a* faces the upper surface of the peeler 340 and sends the air stream generated by the fan 58E to the range between a paper conveyance path 166 extending between the peeler 34C and the belt 28C and the print position 180 from the downstream side. The other air outlet 63E*b* faces a paper conveyance path 167 formed by the belt 28C and guide 24C and sends the air stream generated by the fan 58E to the range between the above path 167 and the print position 190 from the upstream side in the direction X.

The path 60C is formed by a duct 62C extending from a case 61C accommodating the fan 58C toward the print position 190. The duct 62C has an air outlet 63C at its lower end. The air outlet 63C faces the upper surface of the peeler 34D and sends the air stream generated by the fan 58C to the range between a paper conveyance path 165 below the peeler 34D and the print position 190 from the downstream side. The duct 60C has a cross-sectional area sequentially decreasing toward the air outlet 63 in order to increase the flow rate of air around the air outlet 63.

The ducts 62D, 62E and 62C are affixed to the printer body 1000, and each have a width slightly greater than the axial length of associated one of the print drums 1B, 1C and 1D. The ducts 62D, 62E and 62C each are curved along the contours 1*b*, 1*c* or 1*d* of the adjoining print drum 1B, 1C or 1D and so positioned as not to contact the clamper 9B, 9C or 9D when the print drum rotates.

As shown in FIG. 14, the illustrative embodiment also includes the control panel 70 on which a third drum key 176 and a fourth drum key 177 are additionally arranged.

The control means 280 is implemented by a conventional microcomputer including the CPU 81, ROM 182 and RAM 83. The various keys and display of the control panel 70 described in relation to the previous embodiment are connected to the CPU 81. In the illustrative embodiment, additionally connected to the CPU 81 are third and fourth solenoids 43C and 43D, third and fourth drive motors 54C and 54D, and fan motors 59D through 59E as well as third and fourth drum sensors or drum sensing means 189 and 290. In the illustrative embodiment, the drivers 84 and 85 assigned to the master making devices and master discharging devices, respectively, function to drive master making devices and master discharging devices associated with the third and fourth print drums 1C and 1D at the same time. The driver 87 for paper conveyance functions to drive the conveyors 21B and 21C also.

As shown in FIG. 10, the third and fourth drum sensors 189 and 290 are implemented by switches mounted on the print body 1000 and facing the third and fourth print drums 1C and 1D, respectively. When the print drums 1C and 1D are mounted to the printer body 1000, the sensors 189 and 290, respectively, turn on.

The ROM 182 stores the color selective mode, multicolor mode, a first color mode to a third color mode belonging to the color selective mode, the master making program, and printing program. Further, the ROM 182 stores a control program for controlling the positions and drive of the press rollers 2A through 2D and the drive of the air sending means 6A through 6E.

In the color selective mode, the printer executes the discharge of a used master and the feed of a new master with only one of the print drums 1A through 1D selected and executes printing with the drum selected. Specifically, in the illustrative embodiment, when the color selective mode is selected, monocolor printing is effected by using one of the print drums 1A through 1D. In the multicolor mode, the discharge of a used master and the feed of a new master are effected with all of the print drums 1A through 1D, and multicolor printing is executed by using the print drums 1A through 1B.

Reference will be made to FIGS. 15 through 24 for describing a specific operation of the illustrative embodiment, particularly control over the press rollers 2A through 2D and air sending means 6A through 6E executed by the controller 280 in each of the print modes.

First, the operator of the printer presses the color selective mode key 74 or the multicolor mode key 75 to select desired one of the color selective mode and multicolor mode. The operator then presses any one of the first to fourth drum keys 76 through 177 to designate one of the print drums 1A through 1D to use, and then presses the perforation start key 73. In response, the master making program starts to execute the master discharging, master making and master adhering steps. After the master adhering step, the operator presses the print start key 72, so that the printing program starts.

Figure 15:
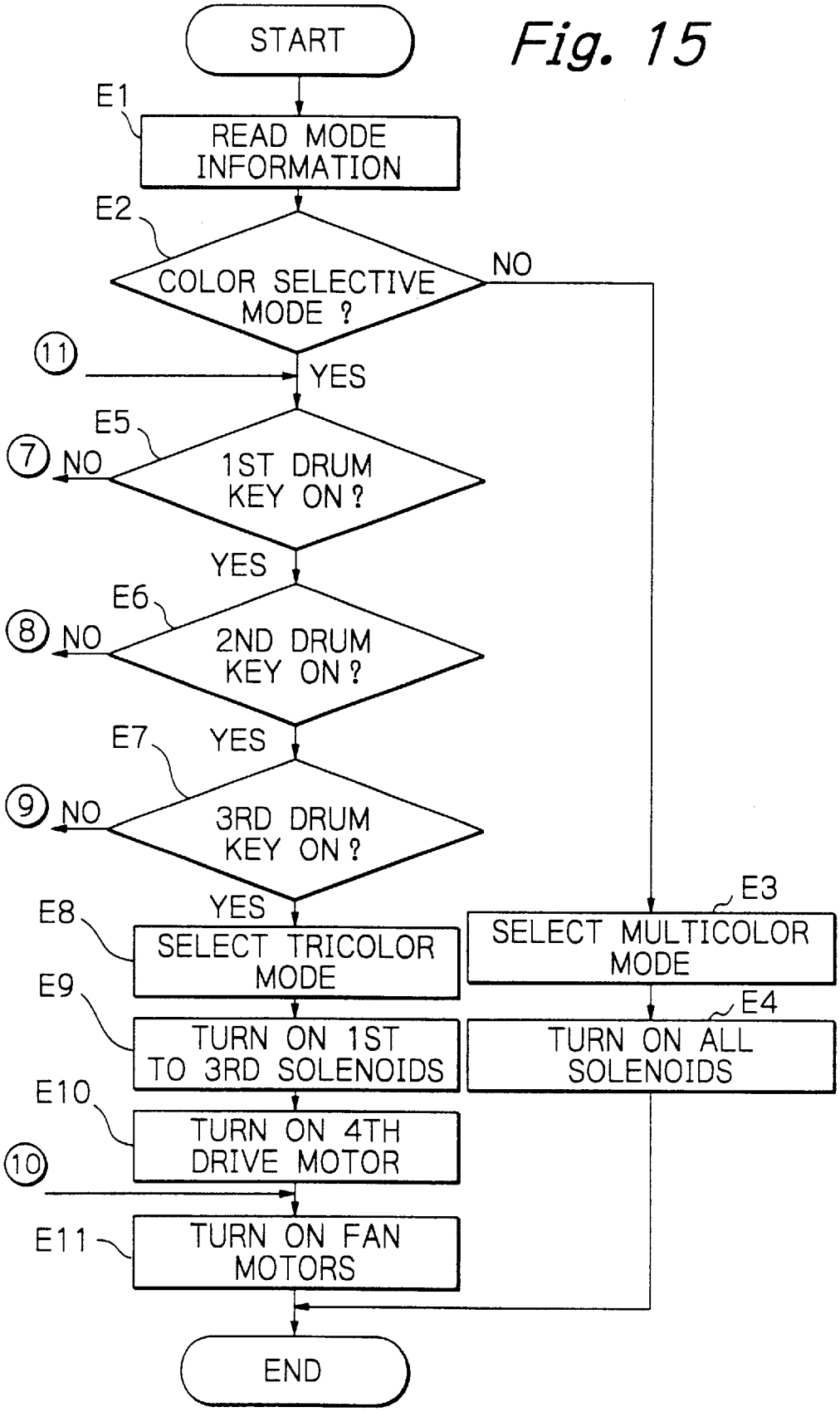
Figure 17:
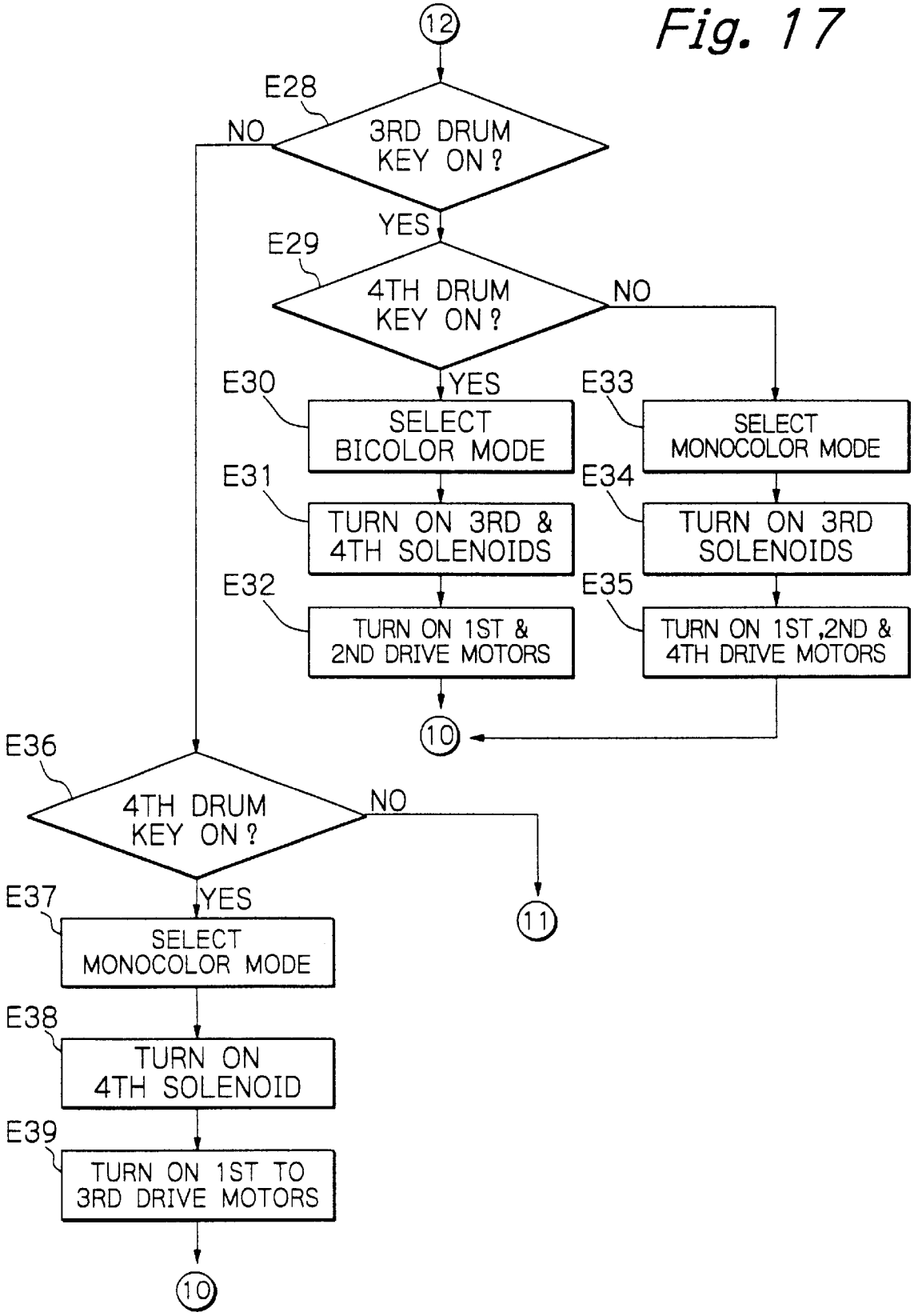

A procedure shown in FIG. 15 starts in parallel with the master making program or the printing program when the key 73 or 72, respectively, is pressed. As shown, the controller 280 reads print mode information input by the operator (step E1) and then determines a print mode (step E2). If the color selective mode is selected on the key 74 (Yes, step E2), the controller 280 advances to step E5. If the answer of the step E2 is No, the controller 280 sets up the multicolor mode (step E3), then drives all of the first to fourth solenoids 43A through 43D (step E4), and then ends the program.

When the solenoids 43A through 43D are energized, the stops 41A through 41D are brought to the releases position shown in FIG. 10 and allow the arms 40A through 40D to rotate clockwise due to the action of the tension springs 47A through 47D. As a result, the press rollers 2A through 2D are respectively pressed against the print drums 1A through 1D (contact position). In this condition, multicolor printing using the four print drums 1A through 1D is effected.

The controller 280 determines the statuses of the first to third drum keys 76, 77 and 176 (steps E5, E6 and E7). If all the answers of the steps E5 through E7 are Yes, the controller 280 determines that the first to third drums 1A through 1C are selected, and then sets up a tricolor mode (step E8). Subsequently, the controller 280 turns on the solenoids 43A through 43C (step E9), energizes the fourth motor 54D (step E10), and turns on all of the fan motors 59A through 59C (step E11).

In the steps E5 through E11, the solenoids 43A through 43C energized pull the stops 41A through 41C, respectively, to their release positions, so that the arms 40A through 40C rotate clockwise. As a result, the press rollers 2A through 2C are pressed against the print drums 1A through 1C, effecting tricolor printing. When the fourth drive motor 54D is energized, the press roller 2D is rotated counterclockwise. When all the fan motors are turned on, the fans 58A, 58B, 58D, 58E and 58C rotate to generate air streams. The air streams from the fans 58A, 58B, 58D, 58E and 58C are respectively sent to the vicinity of the print positions 18, 19, 180 and 190 via the paths 60A, 60B, 60D, 60E and 60C and air outlets 63A, 63B*a*, 63B*b*, 63D*a*, 53D*b*, 63E*a*, 63E*b* and 63C.

Figure 19:
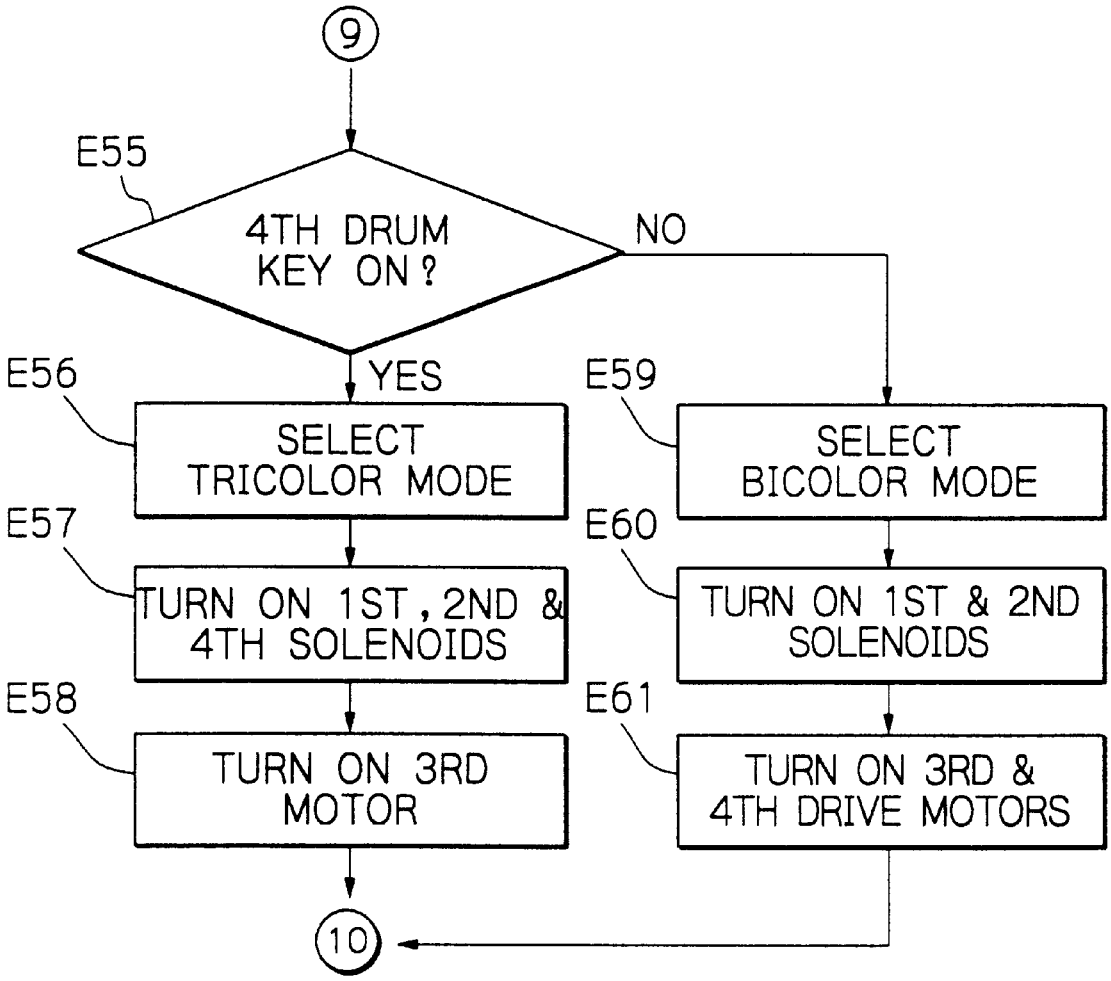

If the drum keys 76, 77 and 176 each are in an OFF state (No, steps E5, E6 and E7), the controller 280 advance to a step E12 shown in FIG. 16 from the step E5, to a step E40 shown in FIG. 18 from the step E6, or to step E55 shown in FIG. 19 from the step E7.

In the step E12 shown in FIG. 16, the controller 280 determines the status of the second drum key 77. If the key 77 is in an ON state (Yes, step E12), the controller 280 determines whether or not the third drum key 176 is in an ON state (step E13). (f the answer of the step E12 is No, the controller 280 advances to step E28 shown in FIG. 17. If the answer of the step E13 is Yes and if the answer of step E14 is also Yes, meaning that the fourth drum key 177 is in an ON state, the controller 280 advances to step E15, determining that the second to fourth drums 1B through 1D are selected. The controller 280 sets up the tricolor mode (step E15) and turns on the second to fourth solenoids 43B through 43D (step E16). Subsequently, the controller 280 turns on the first drive motor 54A (step E17) and turns on all the fan motors (step E11, FIG. 15).

In the steps E12 through E17 executed via the step E11, the solenoids 43B, 43C and 43D energized pull the stops 41B, 41C and 42D, respectively, to their release positions, so that the arms 40B, 40C and 40D rotate clockwise. As a result, the press rollers 2B, 2C and 2D are pressed against the print drums 1B, 1C and 1D, effecting tricolor printing. When the first drive motor 54A is energized, the press roller 2A is rotated counterclockwise. When all the fan motors are turned on, the fans rotate to generate air streams. The air streams are sent to the vicinity of the print positions 18, 19, 180 and 190 via the respective paths and air outlets.

If the answer of the step E13 is No, the controller 280 determines the status of the fourth drum key 177 (step E18). If the key 177 is in an ON state (Yes, step E18), the controller 280 determines that the second and fourth drums 1B and 1D are selected, and then sets up a bicolor mode (step E19). Subsequently, the controller 280 turns on the second and fourth solenoids 43B and 43D (step E20), turns on the first and third drive motors 54A and 54C (step E21), and turns on all the fan motors (step E11, FIG. 15).

In the steps E18 through E11 executed via the step E21, the second and fourth solenoids 43B and 43D energized pull the stops 41B and 41D, respectively, to their release positions, so that the arms 40B and 40D rotate clockwise. As a result, the press rollers 2B and 2D are pressed against the print drums 1B and 1D, effecting bicolor printing. When the first and third drive motors 54A and 54C are energized, the press rollers 2A and 2C are rotated counterclockwise. When all the fan motors are turned on, the fans rotate to generate air streams. The air streams are sent to the vicinity of the print positions 18, 19, 180 and 190 via the respective paths and air outlets.

If the answer of the step E18 is No, the controller 280 determines that only the second drum 1B is selected, and then sets up a monocolor mode (step E22). The controller 280 then turns on the second solenoid 43B (step E23), turns on the first, third and fourth drive motors 54A, 54C and 54D (step E24), and turns on all the fan motors (step E11, FIG. 15).

In the steps E18 through E11 executed via the step E24, the second solenoid 43B energized pulls the stop 41B to its release position, so that the arm 40B rotates clockwise. As a result, the press roller 2B is pressed against the print drum 1B, effecting monocolor printing. When the first, third and fourth drive motors 54A, 54C and 54D are energized, the press rollers 2A, 2C and 2D are rotated counterclockwise. When all the fan motors are turned on, the fans rotate to generate air streams. The air streams are sent to the vicinity of the print positions 18, 19, 180 and 190 via the respective paths and air outlets.

If the answer of the step E14 is No, the controller 280 determines that the second and third drums 1B and 1C are selected, and then sets up the bicolor mode (step E25). The controller 280 then turns on the second and third solenoids 43B and 430 (step E26), turns on the first and fourth drive motors 54A and 54D (step E27), and turns on all the fan motors (step E11, FIG. 15).

In the steps E14 through E11 executed via the step E27, the second and third solenoids 43B and 43C energized pull the stops 41B and 41C, respectively, to their release positions, so that the arms 40B and 40C rotate clockwise. As a result, the press rollers 2B and 2C are pressed against the print drums 1B and 1C, effecting bicolor printing. When the first and fourth drive motors 54A and 54D are energized, the press rollers 2A and 2D are rotated counterclockwise. When all the fan motors are turned on, the fans rotate to generate air streams. The air streams are sent to the vicinity of the print positions 18, 19, 180 and 190 via the respective paths and air outlets.

If the third drum key 176 is in an ON state (Yes, step E28, FIG. 17), the controller 280 determines whether or not the fourth drum key 177 is in an ON state (step E29). If the answer of the step E28 is No, the controller 280 advances to step E36. If the answer of the step E29 is Yes, the controller 280 sets up the bicolor mode (step E30), determining that the third and fourth drums 1C and 1D are selected. Subsequently, the controller 280 turns on the third and fourth solenoids 43C and 43D (step E31), turns on the first and second motors 54A and 54B (step E32), and turns on all of the fan motors (step E11, FIG. 15).

In the steps E28 through E11 executed via the step E32, the third and fourth solenoids 43C and 43D energized pull the stops 41C and 41D, respectively, to their release positions, so that the arms 40C and 40D rotate clockwise. As a result, the press rollers 2C and 2D are pressed against the print drums 1C and 1D, effecting bicolor printing. When the first and second drive motors 54A and 54B are energized, the press rollers 2A and 2B are rotated counterclockwise. When all the fan motors are turned on, the fans rotate to generate air streams. The air streams are sent to the vicinity of the print positions 18, 19, 180 and 190 via the respective paths and air outlets.

If the fourth drum key 177 is in an ON state (Yes, step E36), the controller 280 determines that only the fourth drum 1D is selected, and then sets up the monocolor mode (step E37). Subsequently, the controller 280 executes step E38. If the answer of the step E36 is No, the controller 280 returns to the step E5, FIG. 15, determining that not all the print drums have been selected yet. In the step E38, the controller 280 turns on only the fourth solenoid 43D. The controller 280 then turns on the first, second and third motors 54A, 54B and 54C (step E39) and turns on all the fan motors (step E11, FIG. 15).

In the steps E36 through E11 executed via the step E39, the fourth solenoid 43D energized pulls the stop 41D to its release position, so that the arm 40D rotates clockwise. As a result, the press roller 2D is pressed against the print drum 1D, effecting monocolor printing. When the first, second and third drive motors 54A, 54B and 54C are energized, the press rollers 2A, 2B and 2C are rotated counterclockwise. When all the fan motors are turned on, the fans rotate to generate air streams. The air streams are sent to the vicinity of the print positions 18, 19, 180 and 190 via the respective paths and air outlets.

If the answer of the step E29 is No, the controller 280 determines that only the third print drum 1C is selected, and then sets up the monocolor mode (step E33). The controller 280 then turns on the third solenoid 43C (step E34), turns on the first, second and fourth drive motors 54A, 54B and 54D (step E35), and turns on all the fan motors (step E11, FIG. 15).

In the steps E29 through E11 executed via the step E35, the third solenoid 43C energized pulls the stop 41C to its release position, so that the arm 40C rotates clockwise. As a result, the press roller 2C is pressed against the print drum 1C, effecting monocolor printing. When the first, second and fourth drive motors 54A, 54B and 54D are energized, the press rollers 2A, 2B and 2D are rotated counterclockwise. When all the fan motors are turned on, the fans rotate to generate air streams. The air streams are sent to the vicinity of the print positions 18, 19, 180 and 190 via the respective paths and air outlets.

If the third drum key 176 is in an ON state (Yes, steep E40, FIG. 18), the controller 280 advances to step E41. If the answer of the step E40 is No, the controller 280 executes step E45. If the fourth drum key 177 is in an ON state (Yes, step E41,), the controller 280 sets up the tricolor mode (step E42), determining that the first, third and fourth drums 1A, 1C and 1D are selected. Subsequently, the controller 280 turns on the first, third and fourth solenoids 43A, 43C and 43D (step E43), turns on only the second drive motor 54B (step E44), and turns on all the fan motors (step E11, FIG. 15).

In the steps E40 through E11 executed via the step E44, the first, third and fourth solenoids 43A, 43C and 43D energized pull the stops 41A, 41C and 41D, respectively, to their release positions, so that the arms 40A, 40C and 40D rotate clockwise. As a result, the press rollers 2A, 2C and 2D are pressed against the print drums 1A, 1C and 1D, effecting tricolor printing. When the second drive motor 54B is energized, only the press roller 2B is rotated counterclockwise. When all the fan motors are turned on, the fans rotate to generate air streams. The air streams are sent to the vicinity of the print positions 18, 19, 180 and 190 via the respective paths and air outlets.

If the fourth drum key 177 is in an ON state (Yes, step E45), the controller 280 determines that the first and fourth drum 1A and 1D are selected, and then sets up the bicolor mode (step E46). Subsequently, the controller 280 executes step E47. In the step E47, the controller 280 turns on the first and fourth selenoids 43A and 43D. The controller 280 then turns on the second and third motors 54B and 54C (step E48) and turns on all the fan motors (step E11, FIG. 15).

In the steps E45 through E11 executed via the step E48, the first and fourth solenoids 43A and 43D energized pull the stops 41A and 41D, respectively, to their release positions, so that the arms 40A and 40D rotate clockwise. As a result, the press rollers 2A and 2D are pressed against the print drums 1A and 1D, effecting bicolor printing. When the second and third drive motors 54B and 54C are energized, the press rollers 2B and 2C are rotated counterclockwise. When all the fan motors are turned on, the fans rotate to generate air streams. The air streams are sent to the vicinity of the print positions 18, 19, 180 and 190 via the respective paths and air outlets.

If the fourth drum key 177 is in an OFF state (No, step E45), the controller 280 determines that only the first drum 1A is selected, and then sets up the monocolor mode (step E49). Subsequently, the controller 280 executes step E50. In the step E50, the controller 280 turns on only the first solenoid 43A. The controller 280 then turns on the second, third and fourth motors 54B, 54C and 54D (step ES1) and turns on all the fan motors (step E11, FIG. 15).

In the steps E45 through E11 executed via the step E51, the first solenoid 43A energized pulls the stop 41A to its release position, so that the arm 40A rotates clockwise. As a result, the press roller 2A is pressed against the print drum 1A, effecting monocolor printing. When the second, third and fourth drive motors 54B, 54C and 54D are energized, the press rollers 2B, 2C and 2D are rotated counterclockwise. When all the fan motors are turned on, the fans rotate to generate air streams. The air streams are sent to the vicinity of the print positions 18, 19, 180 and 190 via the respective paths and air outlets.

If the answer of the step E41 is No, the controller 280 determines that the first and third print drum 1A and 1C are selected, and then sets up the bicolor mode (step E52). The controller 280 then turns on the first and third solenoids 43A and 43C (step E53), turns on the second and fourth drive motors 54B and 54D (step E54), and turns on all the fan motors (step E11, FIG. 15).

In the steps E41 through E11 executed via the step E54, the first and third solenoids 43A and 43C energized pull the stops 41A and 41C, respectively, to their release positions, so that the arms 40A and 40C rotate clockwise. As a result, the press rollers 2A and 2C are pressed against the print drums 1A and 1C, effecting bicolor printing. When the second and fourth drive motors 54B and 54D are energized, the press rollers 2B and 2D are rotated counterclockwise. When all the fan motors are turned on, the fans rotate to generate air streams. The air streams are sent to the vicinity of the print positions 18, 19, 180 and 190 via the respective paths and air outlets.

If the fourth drum key 177 is in an ON state (Yes, step E55, FIG. 19), the controller 280 determines that the first, second and fourth drums 1A, 1B and 1D are selected, and then sets up the tricolor mode (step E56). Subsequently, the controller 280 executes step E57. In the step E57, the controller 280 turns on the first, second and fourth solenoids 43A, 43B and 43D. The controller 280 then turns on the third motors 54C (step E58) and turns on all the fan motors (step E11, FIG. 15).

In the steps E55 through E11 executed via the step E58, the first, second and fourth solenoids 43A, 43B and 43D energized pull the stops 41A, 41B and 41D, respectively, to their release positions, so that the arms 40A, 40B and 40D rotate clockwise. As a result, the press rollers 2A, 2B and 2D are pressed against the print drums 1A, 1B and 1D, effecting tricolor printing. When the third drive motor 54C is energized, only the press roller 2C is rotated counterclockwise. When all the fan motors are turned on, the fans rotate to generate air streams. The air streams are sent to the vicinity of the print positions 18, 19, 180 and 190 via the respective paths and air outlets.

If the fourth drum key 177 is in an OFF state (No, step E55), the controller 280 determines that the first and second drums 1A and 1B are selected, and then sets up the bicolor mode (step E59). Subsequently, the controller 280 executes step E60. In the step E60, the controller 280 turns on the first and second solenoids 43A and 43B. The controller 280 then turns on the third and fourth motors 54C and 54D (step E61) and turns on all the fan motors (step E11, FIG. 15).

In the steps E55 through E11 executed via the step E61, the first and second solenoids 43A and 43B energized pull the stops 41A and 41B, respectively, to their release positions, so that the arms 40A and 40B rotate clockwise. As a result, the press rollers 2A and 2B are pressed against the print drums 1A and 1B, effecting bicolor printing. When the third and fourth drive motors 54C and 54D are energized, the press rollers 2C and 2D are rotated counterclockwise. When all the fan motors are turned on, the fans rotate to generate air streams. The air streams are sent to the vicinity of the print positions 18, 19, 180 and 190 via the respective paths and air outlets.

As stated above, the press roller corresponding to the print drum not selected via associated one of the first to fourth print keys 76 through 177 is held in the spaced position by associated one of the holding means 5A through 5D. It is therefore not necessary to wrap a non-perforated stencil around the unused print drum, so that the print cost is reduced. In addition, the printer allowing the operator to select desired one of the print drums is convenient to use.

Assume that three print drums 1B, 1C and 1D are selected. Then, when the printing program starts and causes the paper 22 to be fed in FIG. 12, the press roller 2A rotates in the direction indicated by an arrow while being held at the spaced position by the holding means 5A. The fan 58A sends an air stream toward the paper 22 from above via the air outlet 63A, forcing the paper 22 against the press roller 2A. Further, the air stream being sent via the air outlet 63B*a* at the print position 18 forces the paper 22 against the press drum 12A even after the paper 22 has moved away from the print position 18. In this condition, the rotation of the press roller 2A is successfully transferred to the paper 22 despite that the paper 22 is not nipped between the press roller 2A and the print drum 1A. The paper 22 can therefore be conveyed by a sufficient force without defective conveyance or a jam.

The paper 22 moved away from the print position 18 is conveyed toward the belt 28 while being subjected to the air stream being sent via the air outlet 63B*a*. The belt 28 conveys the paper 22 toward the print position 19 in the direction X while retaining it thereon by suction. When the paper 22 arrives at the print position 19, the press roller 2B presses it with the result that an image is transferred from the master 8B wrapped around the drum 1B to the paper.

When the leading edge of the paper 22 moved away from the print position 19 reaches the path 65, the air stream being sent from the fan 58D via the air outlet 63D*a* acts on the paper 22 from above. This, coupled with the stiffness of the paper 22, separates the paper 22 from the print drum 1B before the paper 22 reaches the peeler 34B and thereby prevents the paper 22 from rolling up. The air stream being sent via the air outlet 63D*a* guides the leading edge of the paper 22 toward the belt 28B. The belt 28B conveys the paper 22 toward the print position 180 while retaining it thereon by suction, as shown in FIG. 13. Even when the paper 22 is not stiff when ink is deposited on the paper 22 in an excessive amount and causes the paper 22 to closely adhere to the print drum 1B, the paper 22 is desirably separated from the print drum 1B by the peeler 34B and the air stream being send via the air outlet 63D*a*.

When the paper 22 being conveyed by the belt 28B approaches the print position 180, the press roller 2C pressed against the print drum 1C by the cam 48C presses the paper 22. At this instant, the air stream being sent via the air outlet 63D*b* acts on the paper 22. In this condition, an image is transferred from the master 8C wrapped around the print drum 1C to the paper 22. When the leading edge of the paper 22 moved away from the print position 180 arrives at the path 166, the air stream being sent via the air outlet 63E*a* acts on the leading edge of the paper 22 from above. This, coupled with the stiffness of the paper 22, separates the paper 22 from the print drum 1C before the paper 22 reaches the peeler 34C and thereby prevents it from rolling up. The air stream being sent via the air outlet 63E*a* guides the leading edge of the paper 22 separated from the print drum 1C toward the belt 28C. The belt 28C conveys the paper 22 toward the print position 190 while retaining it thereon by suction.

When the paper 22 being conveyed by the belt 28C approaches the print position 190, the press roller 2D pressed against the print drum 1D by the cam 48D presses the paper 22 with the result that an image is transferred from the master 8D wrapped around the print drum 1D to the paper. When the leading edge of the paper 22 moved away from the print position 190 arrives at the path 165, the air stream being sent via the air outlet 63C acts on the leading edge from above. This, coupled with the stiffness of the paper 22, separates the paper 22 from the print drum 1D before the paper 22 reaches the peeler 34D and thereby prevents it from rolling up. Finally, the belt 32 conveys the paper 22 peeled off by the peeler 34D to the print tray 20 (see FIG. 10) while retaining it thereon by suction.

Figure 20:
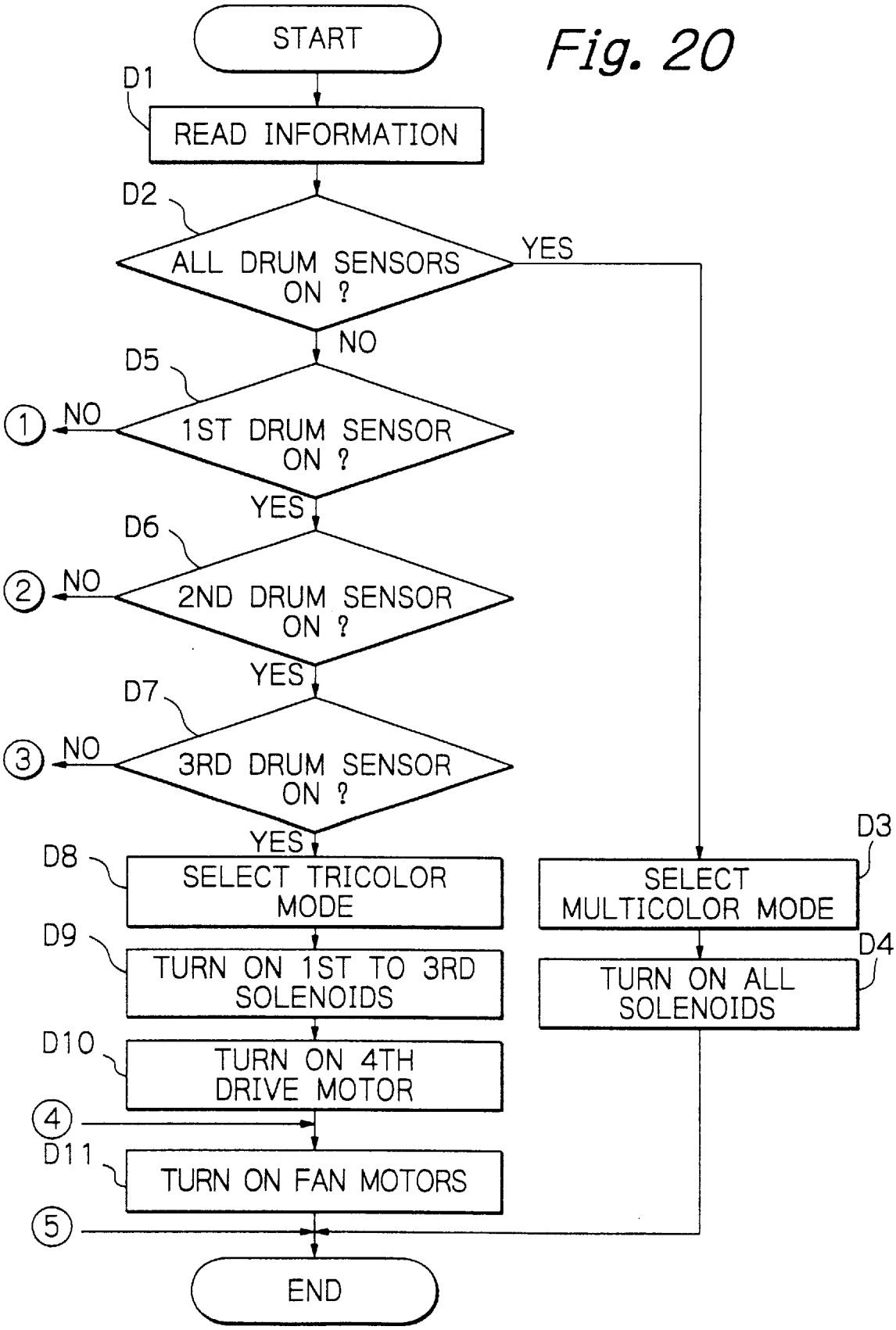
Figure 22:
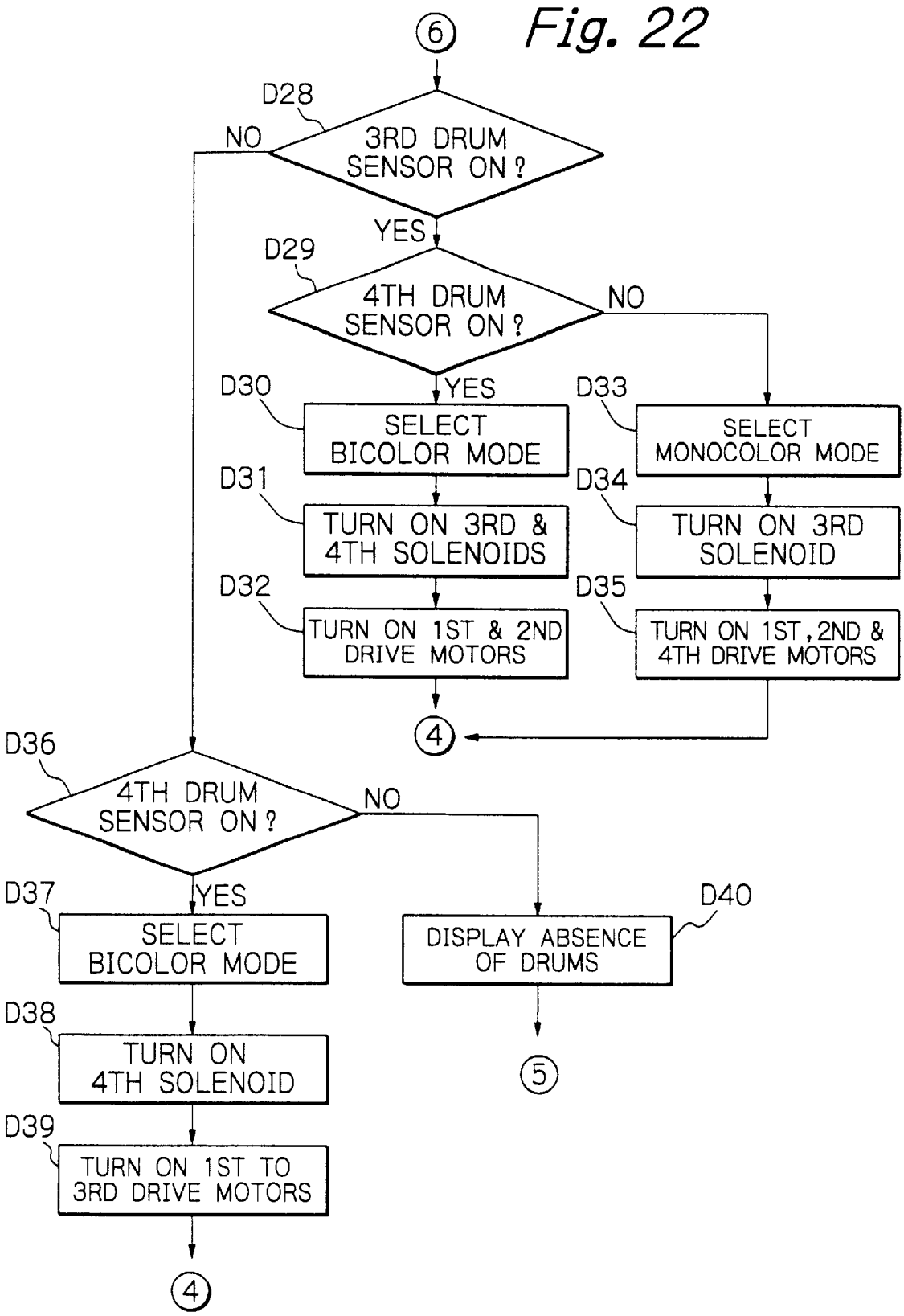

In the illustrative embodiment, too, automatic print mode switching is also available on the basis of the presence/absence of the print drums 1A through 1D, as will be described with reference to FIGS. 20 through 24 hereinafter. As shown in FIG. 20, the controller 280 reads information output from the first to fourth drum sensors 89, 90, 189 and 290 (step D1). If all the drum sensors are in an ON state (Yes, step D2), the controller 280 determines that all the print drums are present on the printer body 1000. The controller 280 then sets up the multicolor mode (step D3) and energizes the first to fourth solenoids (step D4).

When the solenoids are turned on, the stops 41A through 41D are brought to their release positions. As a result, the arms 40A through 40D shown in FIG. 10 are rotated clockwise by the tension springs 47A through 47D, respectively. Consequently, the press rollers 2A through 2D are pressed against the print drums 1A through 1D, respectively, effecting multicolor printing.

If one or more of the drum sensors are in an OFF state (No, step D2), the controller 280 determines the statuses of the first, second and third drum sensors 89, 90 and 189 (steps D5, D6 and D7). If all the drum sensors 89, 90 and 189 are in an ON state, (Yes, steps D5 through D7), the controller 280 determines that the print drums 1A, 1B and 1C are present on the printer body 1000, and then sets up the tricolor mode (step D8). Subsequently, the controller 280 turns on the first to third solenoids 43A, 43B and 43C (step D9), turns on the fourth drive motor 54D (step D10), and turns on all the fan motors (step D11).

By the steps D5 through D11, the solenoids 43A, 43B and 43C energized locate the associated stops at their release positions, causing the arms 40A, 40B and 40C to rotate clockwise. As a result, the press rollers 2A, 2B and 2C are respectively pressed against the print drums 1A, 1B and 1C, effecting tricolor printing. When the fourth drive motor 54D is energized, only the press roller 2D is rotated counterclockwise. Further, all the fan motors are turned on to generate air streams, as stated earlier.

Figure 24:
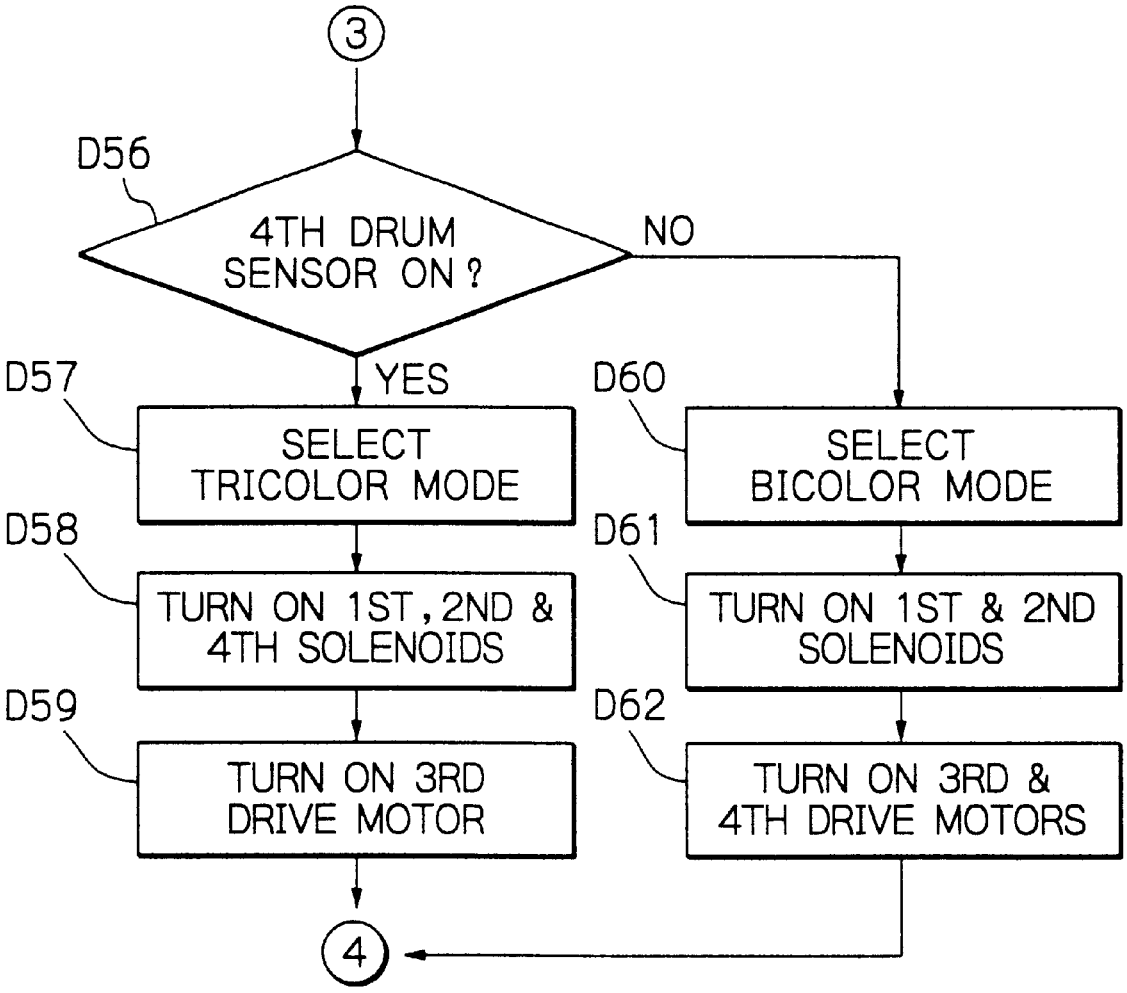

Assume that the answer of any one of the steps D5 through D7 is No. Then, the controller 280 advances from the step D5 to step D12 shown in FIG. 21, or from the step D6 to step D41 shown in FIG. 23, or from the step D7 to step D56 shown in FIG. 24.

In the step D12, FIG. 21, the controller 280 determines whether or not the drum sensor 90 is in an ON state. If the answer of the step D12 is Yes, the controller 280 advances to step D13; otherwise, (No, step D12), the controller 280 advances to step D28 shown in FIG. 22. If the third drum sensor 189 is in an ON state (Yes, step D13) and if the fourth drum sensor 290 is in an ON state (Yes, step D14), the controller 280 sets up the tricolor mode (step D15), determining that the second, third and fourth print drums 1B, 1C and 1D are present on the printer body 1000. Subsequently, the controller 280 turns on the second, third and fourth solenoids 43B, 43C and 43D (step D16), turns on the first drive motor 54A (step D17), and turns on all of the fan motors (step D11, FIG. 20).

In the steps D12 through D11 executed via the step D17, the second, third and fourth solenoids 43B, 43C and 43D energized locate the associated stops at their release positions, causing the arms 40B, 40C and 40C to rotate clockwise. As a result, the press rollers 2B, 2C and 2D are respectively pressed against the print drums 1B, 1C and 1D, effecting tricolor printing. When the first drive motor 54A is energized, only the press roller 2A is rotated counterclockwise. Further, all the fan motors are turned on to generate air streams, as stated earlier.

If the third drum sensor 189 is in an OFF state (No, step D13), the controller 280 determines whether or not the fourth drum sensor 190 is in an ON state (step D18). If the answer of the step D18 is Yes, the controller 280 sets up the bicolor mode (step D19), determining that the second and fourth print drums 1B and 1D are present on the printer body 1000. Subsequently, the controller 280 turns on the second and fourth solenoids 43B and 43D (step D20), turns on the first and third drive motors 54A and 54C (step D21), and turns on all the fan motors (step D11, FIG. 20).

In the steps D18 through D11 executed via the step D21, the second and fourth solenoids 43B and 43D energized locate the stops 41B and 41D, respectively, at their release positions, causing the arms 40B and 40D to rotate clockwise. As a result, the press rollers 2B and 2D are respectively pressed against the print drums 1B and 1D, effecting bicolor printing. When the first and third drive motors 54A and 54C are energized, the press rollers 2A and 2C are rotated counterclockwise. Further, all the fan motors are turned on to generate air streams, as stated earlier.

If the fourth drum sensor 190 is in an OFF state (No, step D18), the controller 280 sets up the monocolor mode (step D22), determining that only the second print drum 1B is present on the printer body 1000. Subsequently, the controller 280 turns on only the second solenoid 43B (step D23), turns on the first, third and fourth drive motors 54A, 54C and 54D (step D24), and turns on all the fan motors (step D11, FIG. 20).

In the steps D18 through D11 executed via the step D24, the second solenoid 43B energized locates the stop 41B at its release position, causing the arm 40B to rotate clockwise. As a result, the press roller 2B is pressed against the print drum 1B, effecting monocolor printing. When the first, third and fourth drive motors 54A, 54C and 54D are energized, the press rollers 2A, 2C and 2D are rotated counterclockwise. Further, all the fan motors are turned on to generate air streams, as stated earlier.

If the fourth drum sensor 190 is in an OFF state (No, step D14), the controller 280 sets up the bicolor mode (step D25), determining that the second and third print drums 1B and 1C are present on the printer body 1000. Subsequently, the controller 280 turns on the second and third solenoid 43B and 43C (step D26), turns on the first and fourth drive motors 54A and 54D (step D27), and turns on all the fan motors (step D11, FIG. 20).

In the steps D14 through D11 executed via the step D27, the second and third solenoids 43B and 43C energized locate the stops 41B and 41C, respectively, at their release positions, causing the arms 40B and 40C to rotate clockwise. As a result, the press rollers 2B and 2C are respectively pressed against the print drums 1B and 1C, effecting bicolor printing. When the first and fourth drive motors 54A and 54D are energized, the press rollers 2A and 2D are rotated counterclockwise. Further, all the fan motors are turned on to generate air streams, as stated earlier.

If the third drum sensor 189 is in an ON state (Yes, step D28), the controller 280 advances to step D29; otherwise (No, step D28), the controller 280 advances to step D36. If the fourth drum sensor 290 is in an ON state (Yes, step D29), the controller 280 sets up the bicolor mode (step D30), determining that the third and fourth print drums 1C and 1D are present on the printer body 1000. Subsequently the controller 280 turns on the third and fourth solenoids 43C and 43D (step D31), turns on the first and second drive motors 54A and 54B (step D32), and turns on all the fan motors (step D11, FIG. 20).

In the steps D28 through D11 executed via the step D32, the third and fourth solenoids 43C and 43D energized locate the stops 41C and 41D, respectively, at their release positions, causing the arms 40C and 40D to rotate clockwise. As a result, the press rollers 2C and 2D are respectively pressed against the print drums 1C and 1D, effecting bicolor printing. When the first and second drive motors 54A and 54B are energized, the press rollers 2A and 2B are rotated counterclockwise. Further, all the fan motors are turned on to generate air streams, as stated earlier.

If the fourth drum sensor 290 is in an ON state (Yes, step D36), the controller 280 sets up the monocolor mode (step D37), determining that only the fourth print drum 1D is present on the printer body 1000. If the answer of the step D36 is No, the controller 280 ends the control, determining that none of the print drums is present on the printer body 1000 (step D40). Subsequently the controller 280 turns on only the fourth solenoid 43D (step D38), turns on the first, second and third drive motors 54A, 54B and 54C (step D39), and turns on all the fan motors (step D11, FIG. 20).

In the steps D36 through D11 executed via the step D39, the fourth solenoid 43D energized locates the stop 41D at its release position, causing the arm 40D to rotate clockwise. As a result, the press roller 2D is pressed against the print drums 1D, effecting monocolor printing. When the first, second and third drive motors 54A, 5B and 54C are energized, the press rollers 2A, 2B and 2C are rotated counterclockwise. Further, all the fan motors are turned on to generate air streams, as stated earlier.

If the fourth drum sensor 290 is in an OFF state (No, step D29), the controller 280 sets up the monocolor mode (step D33), determining that only the third print drum 1C is present on the printer body 1000. Subsequently, the controller 280 turns on only the third solenoid 43C (step D34), turns on the first, second and fourth drive motors 54A, 54B and 54D (step D35), and turns on all the fan motors (step D11, FIG. 20).

In the steps D29 through D11 executed via the step D35, the third solenoid 43C energized locates the stop 41C at its release position, causing the arm 40C to rotate clockwise. As a result, the press roller 2C is pressed against the print drums 1C, effecting monocolor printing. When the first, second and fourth drive motors 54A, 5B and 54D are energized, the press rollers 2A, 2B and 2D are rotated counterclockwise. Further, all the fan motors are turned on to generate air streams, as stated earlier.

If the third drum sensor 189 is in an ON state (Yes, step D41), controller 280 advances to step D42; otherwise, (No, step D41), the controller 280 advances to step D46. If the fourth drum sensor 290 is in an ON state (Yes, step D42), the controller sets up the tricolor mode (step D43), determining that the first, third and fourth print drums 1A, 1C and 1D are present on the printer body 1000. Subsequently, the controller 280 turns on the first, third and fourth solenoids 43A, 43C and 43D (step D44), turns on only the second motor 54B (step D45), and turns on all the fan motors (step D11, FIG. 20).

In the steps D41 through D11 executed via the step D45, the first, third and fourth solenoids 43A, 43C and 43D energized locate the stops 41A, 41C and 41D, respectively, at their release positions, causing the arms 40A, 40C and 40D to rotate clockwise. As a result, the press rollers 2A, 2C and 2D are respectively pressed against the print drums 1A, 1C and 1D, effecting tricolor printing. When the second drive motor 54B is energized, only the press roller 2B is rotated counterclockwise. Further, all the fan motors are turned on to generate air streams, as stated earlier.

If the fourth drum sensor 290 is in an ON state (Yes, step D46), the controller 280 sets up the bicolor mode (step D47), determining that the first and fourth print drums 1A and 1D are present on the printer body 1000. Subsequently the controller 280 turns on the first and fourth solenoids 43A and 43D (step D48), turns on the second and third drive motors 54B and 54C (step D49), and turns on all the fan motors (step D11, FIG. 20).

In the steps D46 through D11 executed via the step D49, the first and fourth solenoids 43A and 43D energized locate the stops 41A and 41D, respectively, at their release positions, causing the arms 40A and 40D to rotate clockwise. As a result, the press rollers 2A and 2D are respectively pressed against the print drums 1A and 1D, effecting bicolor printing. When the second and third drive motors 54B and 54C are energized, the press rollers 2B and 2C are rotated counterclockwise. Further, all the fan motors are turned on to generate air streams, as stated earlier.

If the fourth drum sensor 290 is in an OFF state (No, step D46), the controller 280 sets up the monocolor mode (step D50), determining that only the first print drum 1A is present on the printer body 1000. Subsequently, the controller 280 turns on only the first solenoid 43A (step D51), turns on the second, third and fourth drive motors 548, 54C and 54D (step D52), and turns on all the fan motors (step D11, FIG. 20).

In the steps D46 through D11 executed via the step D52, the first solenoid 43A energized locates the stop 41A at its release position, causing the arm 40A to rotate clockwise. As a result, the press roller 2A is pressed against the print drums 1A, effecting monocolor printing. When the second, third and fourth drive motors 54B, 5C and 5D are energized, the press rollers 2B, 2C and 2D are rotated counterclockwise. Further, all the fan motors are turned on to generate air streams, as stated earlier.

If the fourth drum sensor 290 is in an OFF state (No, step D42), the controller 280 sets up the bicolor mode (step D53), determining that the first and third print drums 1A and 1C are present on the printer body 1000. Subsequently, the controller 280 turns on the first and third solenoids 43A and 43C (step D54), turns on the second and fourth drive motors 54B and 54D (step D55), and turns on all the fan motors (step D11, FIG. 20).

In the steps D42 through D11 executed via the step D55, the first and third solenoids 43A and 43C energized locate the stops 41A and 41C, respectively, at their release positions, causing the arms 40A and 40C to rotate clockwise. As a result, the press rollers 2A and 2C are respectively pressed against the print drums 1A and 1C, effecting bicolor printing. When the second and fourth drive motors 54B and 54D are energized, the press rollers 2B and 2D are rotated counterclockwise. Further, all the fan motors are turned on to generate air streams, as stated earlier.

If the fourth drum sensor 290 is in an ON state (Yes, step D56, FIG. 24), the controller 280 sets up the tricolor mode (step D57), determining that the first, second and fourth print drums 1A, 1B and 1D are present on the printer body 1000. Subsequently the controller 280 turns on the first, second and fourth solenoids 43A, 43B and 43D (step D58), turns on only the third drive motor 54C (step D59), and turns on all the fan motors (step D1, FIG. 20).

In the steps D56 through D11 executed via the step D59, the first, second and fourth solenoids 43A, 43B and 43D energized locate the stops 41A, 41B and 41D, respectively, at their release positions, causing the arms 40A, 40B and 40D to rotate clockwise. As a result, the press rollers 2A, 2B and 2D are respectively pressed against the print drums 1A, 1B and 1D, effecting tricolor printing. When the third drive motor 54C is energized, only the press roller 2C is rotated counterclockwise. Further, all the fan motors are turned on to generate air streams, as stated earlier.

If the fourth drum sensor 290 is in an OFF state (No, step D56), the controller 280 sets up the bicolor mode (step D60), determining that the first and second print drums 1A and 1B are present on the printer body 1000. Subsequently, the controller 280 turns on the first and second solenoids 43A and 43B (step D61), turns on the third and fourth drive motors 54C and 54D (step D62), and turns on all the fan motors (step D11, FIG. 20).

In the steps D56 through D11 executed via the step D62, the first and second solenoids 43A and 43B energized locate the stops 41A and 41B, respectively, at their release positions, causing the arms 40A and 40B to rotate clockwise. As a result, the press rollers 2A and 2B are respectively pressed against the print drums 1A and 1B, effecting bicolor printing. When the third and fourth drive motors 54C and 54D are energized, the press rollers 2C and 2D are rotated counterclockwise. Further, all the fan motors are turned on to generate air streams, as stated earlier.

For example, when the first and second print drums 1A and 1B shown in FIG. 10 are absent on the printer body 1000, the controller 280 automatically sets up the bicolor mode using the third and fourth print drums 1C and 1D. When the first print drum 1A is absent, the controller 280 automatically selects the tricolor mode using the second, third and fourth print drums 1B, 1C and 1D. This makes it needless for the operator to care whether or not the print drums are present on the printer body 100. This is extremely advantageous when it comes to a multicolor printer including four print drums as in the illustrative embodiment.

Of course, the illustrative embodiment, like the previous embodiment, causes the press roller corresponding to the print drum absent on the printer body 1000 to rotate at the spaced position and sends air to the consecutive print positions. Therefore, even when the paper 22 passes any one of the print positions where the print drum is absent, the air streams force the paper 22 against the above press roller. This guarantees a sufficient conveying force and thereby surely obviates defective transfer and jam ascribable to a short conveying force.

In the embodiments shown and described, all the air sending means 6A, 6B, 6D, 6E and 6C are driven at the same time in order to send air to the vicinity of the print positions 18, 19, 180 and 190. This prevents the paper 22 from rolling up together with the print drums 1A through 1D. Alternatively, the control means 80 or 280 may control the fan motors 59A, 59B, 59D, 59E and 59C such that air is sent only to the vicinity of the press rollers spaced from the associated print drums, which may even be absent, neglecting the roll-up problem. With this control, it is possible to reduce noise ascribable to air streams and the operation ratio of the motors, i.e., to enhance silent operation and durability of the printer.

If desired, the bifurcated air sending means 6B, 6D and 6E each may be replaced with two discrete paths, in which case a particular drive motor will be assigned to each of the discrete paths.

While each illustrative embodiment is implemented as a stencil printer including a thermal digital master making device, the master making devices and master discharging devices do not have to be arranged on the printer body 100 or 1000. For example, masters made by master making devices independent of the printer body 100 or 1000 may be wrapped around the print drums, and used masters may be peeled off after the printing operation. As for image data for making masters, the scanner shown and described may be replaced with a computer or similar data input/output unit independent of the printer. It is to be noted that the color selective mode includes a mode in which one of a plurality of print drums to be used for printing is simply selected.

In summary, it will be seen that the present invention provides a multicolor stencil printer having various unprecedented advantages, as enumerated below.

(1) When a color selective mode is selected, holding means assigned to a pressing member, which corresponds to a print drum unused in the above mode, holds the pressing member at a spaced position spaced from the print drum. This prevents the unused print drum and the associated pressing member from contacting each other and thereby makes it needless to wrap a non-perforated stencil around the unused print drum. The printer therefore reduces the print cost.

(2) When desired one of a plurality of print drums is selected in the color selective mode, control means energizes an electromagnetic actuator so as to bring the pressing member corresponding to the above print drum to a contact position contacting the print drum. Printing can therefore be effected with the print drum selected. Further, the holding means assigned to the pressing members associated with the unused print drums hold the pressing members at the spaced positions. This allows a desired print drum to be selected in the color selective mode while preventing the unused print drums and pressing members associated therewith from contacting each other. It follows that non-perforated stencils do not have to be wrapped around the unused print drums. The printer therefore reduces the print cost and is convenient to use.

(3) The printer automatically sets up the color selective mode or a multicolor mode on the basis of the presence/absence of the print drums. In the color selective mode, the control means energizes the electromagnetic actuator so as to bring the pressing member corresponding to the print drum sensed by drum sensing means into contact with the print drum. Printing can therefore be effected with the print drum selected. Further, the holding means assigned to the pressing members associated with the print drums not sensed hold the pressing members at the spaced positions. This makes it needless to wrap non-perforated stencils around the unused print drums and therefore reduces the print cost while preventing the unused print drums and pressing members associated therewith from contacting each other. In addition, the printer is convenient to use and reduces operator's mishandling to thereby enhance reliable operation.

(4) Drive means causes the pressing member to rotate in a direction opposite to a direction in which the associated print drum rotates during printing. Therefore, even the pressing member held at the spaced position can exert a sufficient conveying force on a paper. This also makes it needless to wrap non-perforated stencil is around the unused print drums and therefore reduces the print cost. In addition, a paper can be desirably conveyed even if it is not pressed by the pressing member.

(5) An air stream source sends air toward a paper around a print position where the print drum and associated pressing member face each other from the print drum side. Therefore, even when the holding means holds the pressing member at the spaced position, the air stream forces the paper against the pressing member rotating in the previously stated direction and allows the rotation of the pressing member to be efficiently transferred to the paper. It follows that the conveying force to act on the paper is increased and obviates defective conveyance.

(6) Because desired one of the multicolor mode and color selective mode can be selected, prints matching a desired application can be produced.

Various modifications will become possible for those skilled in the art after receiving the teachings of the present disclosure without departing from the scope thereof.

What is claimed is:

1. A multicolor stencil printer comprising:

a plurality of print drums each storing an ink of a particular color therein;

a plurality of pressing members each positioned and configured to move into contact with a particular one of said print drums to nip a recording medium for printing an image and move out of the contact with the particular one of said print drums to transport the recording medium toward downstream; and a plurality of holding devices each configured to hold a particular one of said pressing members out of the contact with said particular one of said print drums;

wherein:

when the printer is operated in a color selective mode, said print drums and said pressing members selectively cooperate to nip the recording medium for printing such that at least one of the pressing members is held out of contact with a corresponding one of the print drums by a corresponding one of said holding devices; and said plurality of holding devices each comprise an arm rotatably supporting a respective one of said pressing members and configured to move said respective one of said pressing members between a contact position where a circumference of said respective one of said pressing members is pressed against a circumference of a respective one of the print drums therewith and a spaced position where the circumference of said respective one of said pressing members is spaced from the circumference of said respective one of said print drums, a stop configured to engage with said arm to hold said arm at said spaced position, biasing means for biasing said stop toward said arm, and an electromagnetic actuator configured to move said stop away from said arm.

2. The multicolor stencil printer as claimed in claim 1, further comprising;

drum selecting means for selecting a desired one of said print drums; and driving means for driving, in said color selective mode, said electromagnetic actuator to move said stop away from said arm such that the respective one of said pressing members associated with the respective one of said print drums selected by said drum selecting means is brought to said contact position.

3. The multicolor stencil printer as claimed in claim 1, further comprising:

a plurality of drum sensing means each for sensing whether a particular one of said print drums is present; and setting means for setting up, based on an output from said drum sensing means, one of said color selective mode and a multicolor mode in which said print drums and said pressing members all cooperate to nip the recording medium for printing.

4. The multicolor stencil printer as claimed in claim 3, wherein said setting means sets up one of said color selective mode when at least one of said drum sensing means senses an associated one of said print drums and said multicolor mode when all of said drum sensing means sense associated ones of said print drums.

5. The multicolor stencil printer as claimed in claim 3, further comprising print mode selecting means for selecting one of said multicolor mode and said color selective mode.

6. The multicolor stencil printer as claimed in claim 1, further comprising rotating means for rotating a respective one of said pressing members in a direction opposite to a direction in which an associated one of said print drums rotates during printing.

7. The multicolor stencil printer as claimed in claim 6, further comprising air sending means comprising an air stream generator for generating an air steam and a guide for guiding said air stream to the vicinity of a location where a respective one of print drums and a respective one of the pressing members face each other.

8. A multicolor stencil printer comprising:

a plurality of print drums each storing an ink of a particular color therein;

a plurality of pressing devices each positioned and configured to move into contact with a particular one of said print drums to nip a recording medium for printing an image and move out of the contact with the particular one of said print drums to transport the recording medium toward downstream, said pressing devices each including a holding device configured to hold a respective one of said pressing devices out of the contact with said particular one of said print drums; and a print mode selecting device configured to select one of a multicolor mode in which said print drums and said pressing devices nip the recording medium for printing and a color selective mode in which said print drums and said pressing devices selectively cooperate to nip the recording medium for printing;

wherein said holding device comprises an arm rotatably supporting a respective one of said pressing members and configured to move said respective one of said pressing members between a contact position where a circumference of said respective one of said pressing members is pressed against a circumference of a respective one of the print drums therewith and a spaced position where the circumference of said respective one of said pressing members is spaced from the circumference of said respective one of said print drums, a stop configured to engage with said arm to hold said arm at said spaced position, biasing means for biasing said stop toward said arm, and an electromagnetic actuator configured to move said stop away from said arm.

9. A multicolor stencil printer comprising:

a plurality of print drums each storing an ink of a particular color therein;

a plurality of pressing devices each positioned and configured to move into contact with a particular one of said print drums and move out of the contact with the particular one of said print drums to transport the recording medium toward downstream, said pressing devices each including a holding device configured to hold a respective one of said pressing devices out of the contact with said particular one of said print drums; and print mode selecting means for selecting one of a multicolor mode in which said print drums and said pressing devices nip the recording medium for printing and a color selective mode in which said print drums and said pressing devices selectively cooperate to nip the recording medium for printing;

wherein said holding device comprises an arm rotatably supporting a respective one of said pressing members and configured to move said respective one of said pressing members between a contact position where a circumference of said respective one of said pressing members is pressed against a circumference of a respective one of the print drums therewith and a spaced position where the circumference of said respective one of said pressing members is spaced from the circumference of said respective one of said print drums, a stop configured to engage with said arm to hold said arm at said spaced position, biasing means for biasing said stop toward said arm, and an electromagnetic actuator configured to move said stop away from said arm.

* * * * *

UNITED STATES PATENT AND TRADEMARK OFFICE

CERTIFICATE OF CORRECTION

PATENT NO. : 6,393,978 B1
DATED : May 28, 2002
INVENTOR(S) : Mitsuhiro Sugawara et al.

It is certified that error appears in the above-identified patent and that said Letters Patent is hereby corrected as shown below:

Column 2,
Line 5, change "showing a, pressing" to -- showing a pressing --.

Column 3,
Line 33, change "dampers" to -- clampers --.

Column 5,
Line 8, change "engagable" to -- engageable --;
Line 42, change "damper" to -- clamper --;
Line 47, change "damper" to -- clamper --.

Column 7,
Line 29, change "damper" to -- clamper --.

Column 8,
Line 55, change "to a step A3 the answer" to -- to a step A3. If the answer --.

Column 10,
Line 27, change "18" to -- 1B --.

Column 11,
Line 11, change "printing, program" to -- printing program --.

Column 13,
Line 19, change "280" to -- 28C --.;
Line 66, change "damper" to -- clamper --.

Column 14,
Line 42, change "690" to -- 69D --.

Column 17,
Line 32, change "(f" to -- If --.

Column 20,
Line 24, change "ES1" to -- E51 --.

UNITED STATES PATENT AND TRADEMARK OFFICE

CERTIFICATE OF CORRECTION

PATENT NO. : 6,393,978 B1
DATED : May 28, 2002
INVENTOR(S) : Mitsuhiro Sugawara et al.

It is certified that error appears in the above-identified patent and that said Letters Patent is hereby corrected as shown below:

Column 21,
Line 48, change "12A" to -- 2A --.

Column 26,
Line 41, change "D1" to -- D11 --.

Signed and Sealed this

Eighteenth Day of February, 2003

JAMES E. ROGAN
*Director of the United States Patent and Trademark Office*